US011053045B2

(12) United States Patent
Chambers

(10) Patent No.: US 11,053,045 B2
(45) **Date of Patent: *Jul. 6, 2021**

(54) LOCKING PACKAGING CONTAINER

(71) Applicant: All Packaging Company, Aurora, CO (US)

(72) Inventor: Christopher Chambers, Aurora, CO (US)

(73) Assignee: All Packaging Company, Aurora, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/691,409

(22) Filed: Nov. 21, 2019

(65) Prior Publication Data

US 2020/0108970 A1 Apr. 9, 2020

Related U.S. Application Data

(63) Continuation of application No. 15/814,188, filed on Nov. 15, 2017, now Pat. No. 10,518,927, which is a (Continued)

(51) Int. Cl.
*B65D 5/20* (2006.01)
*B65D 5/22* (2006.01)
(Continued)

(52) U.S. Cl.
CPC ..... *B65D 5/2057* (2013.01); *B65D 5/10* (2013.01); *B65D 5/22* (2013.01); *B65D 5/38* (2013.01); *B65D 5/4204* (2013.01); *B65D 5/48014* (2013.01); *B65D 5/5007* (2013.01); *B65D 5/5035* (2013.01); *B65D 5/541* (2013.01); *B65D 5/6664* (2013.01); *B65D 2215/02* (2013.01);
(Continued)

(58) Field of Classification Search
CPC . B65D 5/38; B65D 77/22; B65D 5/10; B65D 5/2057; B65D 5/22; B65D 5/4204; B65D 5/48014; B65D 5/5007; B65D 5/5035; B65D 5/541; B65D 5/6664; B65D 2401/10; B65D 2215/02; B65D 2215/04
USPC ..... 206/1.5, 528, 538
See application file for complete search history.

(56) References Cited

U.S. PATENT DOCUMENTS 3,241,738 A 3/1966 Freiman
4,561,544 A * 12/1985 Reeve ..... B65D 11/12 206/1.5

(Continued)

OTHER PUBLICATIONS

Search Opinion issued in EP17905313.7 dated Apr. 28, 2020, 2 pgs.

(Continued)

*Primary Examiner* — Steven A. Reynolds
(74) *Attorney, Agent, or Firm* — Holland & Hart LLP

(57) ABSTRACT

The technology disclosed herein includes a storage apparatus comprising an inner sleeve, including a first tab including memory-inducing laminated material, a second tab including memory-inducing laminated material, and an inner sleeve storage compartment; and an outer sleeve encompassing the inner sleeve when the storage apparatus is locked, and including a first aperture for receiving the first tab in a first locking mechanism, and a second aperture for receiving the second tab in a second locking mechanism.

15 Claims, 26 Drawing Sheets

Related U.S. Application Data continuation-in-part of application No. 15/487,113, filed on Apr. 13, 2017, now Pat. No. 10,479,581.

(60) Provisional application No. 62/322,614, filed on Apr. 14, 2016.

(51) Int. Cl.

| | |
|---|---|
| ***B65D 5/38*** | (2006.01) |
| ***B65D 5/66*** | (2006.01) |
| ***B65D 5/54*** | (2006.01) |
| ***B65D 5/50*** | (2006.01) |
| ***B65D 5/48*** | (2006.01) |
| ***B65D 5/10*** | (2006.01) |
| ***B65D 5/42*** | (2006.01) |

(52) U.S. Cl.

CPC ..... *B65D 2215/04* (2013.01); *B65D 2401/10* (2020.05)

(56) References Cited

U.S. PATENT DOCUMENTS 6,641,031 B2 * 11/2003 Evans ..... B65D 5/38 206/532
7,708,142 B2 * 5/2010 Ehrlund ..... B65D 5/38 206/1.5
7,757,843 B2 * 7/2010 Katsis ..... A24F 27/00 206/1.5
7,854,325 B2 12/2010 Bentele
8,011,512 B2 9/2011 Brollier et al.
8,453,840 B2 * 6/2013 Wharton ..... B65D 11/12 206/531
8,567,607 B2 10/2013 Fischer
8,701,889 B2 4/2014 Loftin
9,475,605 B2 10/2016 Everett
9,783,335 B2 10/2017 Everett
9,981,788 B2 * 5/2018 Skinner ..... B65D 50/046
10,479,581 B2 * 11/2019 Chambers ..... B65D 5/5035
10,518,927 B2 * 12/2019 Chambers ..... B65D 5/5007
2004/0099565 A1 5/2004 Dehlin et al.
2007/0175789 A1 8/2007 Ronnberg et al.
2007/0181458 A1 * 8/2007 Ehrlund ..... B65D 5/38 206/528
2008/0217197 A1 9/2008 Peters et al.
2008/0314780 A1 12/2008 Weston
2009/0152134 A1 6/2009 Katsis
2009/0255832 A1 * 10/2009 Bentele ..... B65D 5/38 206/1.5
2011/0036743 A1 2/2011 Wharton
2012/0261275 A1 * 10/2012 Intini ..... A61J 1/035 206/1.5
2013/0140201 A1 6/2013 Ghini
2016/0001937 A1 * 1/2016 Skinner ..... B65D 5/38 206/1.5
2016/0152373 A1 * 6/2016 Linssen ..... B65D 5/38 206/1.5
2016/0251107 A1 9/2016 Everett
2017/0036808 A1 * 2/2017 Everett ..... B65D 5/38
2017/0072452 A1 3/2017 Monetti et al.
2017/0217658 A1 * 8/2017 Whitehurst ..... B65D 79/00
2017/0297803 A1 10/2017 Chambers et al.
2018/0022498 A1 * 1/2018 Everett ..... B65D 5/541 206/1.5
2018/0072452 A1 * 3/2018 Chambers ..... B65D 5/2057
2018/0105314 A1 4/2018 Jones
2019/0225366 A1 * 7/2019 Whitehurst ..... B65D 5/38
2019/0337689 A1 * 11/2019 Mazurek ..... B65D 5/503
2020/0039717 A1 2/2020 Chambers et al.
2020/0087020 A1 3/2020 Tsai et al.

OTHER PUBLICATIONS

Supplementary European Search Report issued in EP17905313 dated Dec. 14, 2020, 2 pgs.
International Preliminary Report on Patentability issued in PCT/US2017/061858 dated Oct. 15, 2019, 5 pgs.
Written Opinion issued in PCT/US2017/061858 dated Jan. 31, 2018, 4 pgs.

* cited by examiner

LOCKING PACKAGING CONTAINER

PRIORITY CLAIM

This application is a continuation of U.S. application Ser. No. 15/814,188 filed Nov. 15, 2017, titled: "LOCKING PACKAGING CONTAINER" which claims benefit of priority to U.S. application Ser. No. 15/487,113 filed Apr. 13, 2017, which claims the benefit of priority to U.S. application Ser. No. 62/322,614 filed Apr. 14, 2016, the entire disclosures of which are incorporated herein by reference for all purposes.

BACKGROUND

Cartons or other paperboard containers may be used for holding and storing items. In some implementations, the items held or stored in the containers may be harmful to certain users, such as children (e.g., a pharmaceutical drug). A user may desire to hold or store items in a relockable, child-resistant container.

SUMMARY

The technology disclosed herein includes a locking packaging apparatus comprising an outer sleeve, an inner sleeve, and at least one locking mechanism configured to lock the inner sleeve inside the outer sleeve. In some implementations, the locking mechanism is an interior sliding mechanism, which locks the inner sleeve in its entirety in the outer sleeve. In some implementations, the locking mechanism is an interior sliding mechanism, which permits the inner sleeve to move partially out of the outer sleeve and prevents complete removal of the inner sleeve from the outer sleeve. In some implementations, the locking mechanism includes a spring, a tab, a flap, a key, a magnet lock, or other locking component. In some implementations, the inner sleeve includes a pull tab for removal of the inner sleeve from inside the outer sleeve. In some implementations, the packaging apparatus may include memory-inducing and tear-resistant laminated material.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

These and various other features and advantages will be apparent from a reading of the following Detailed Description.

DETAILED DESCRIPTION

Figure 1:
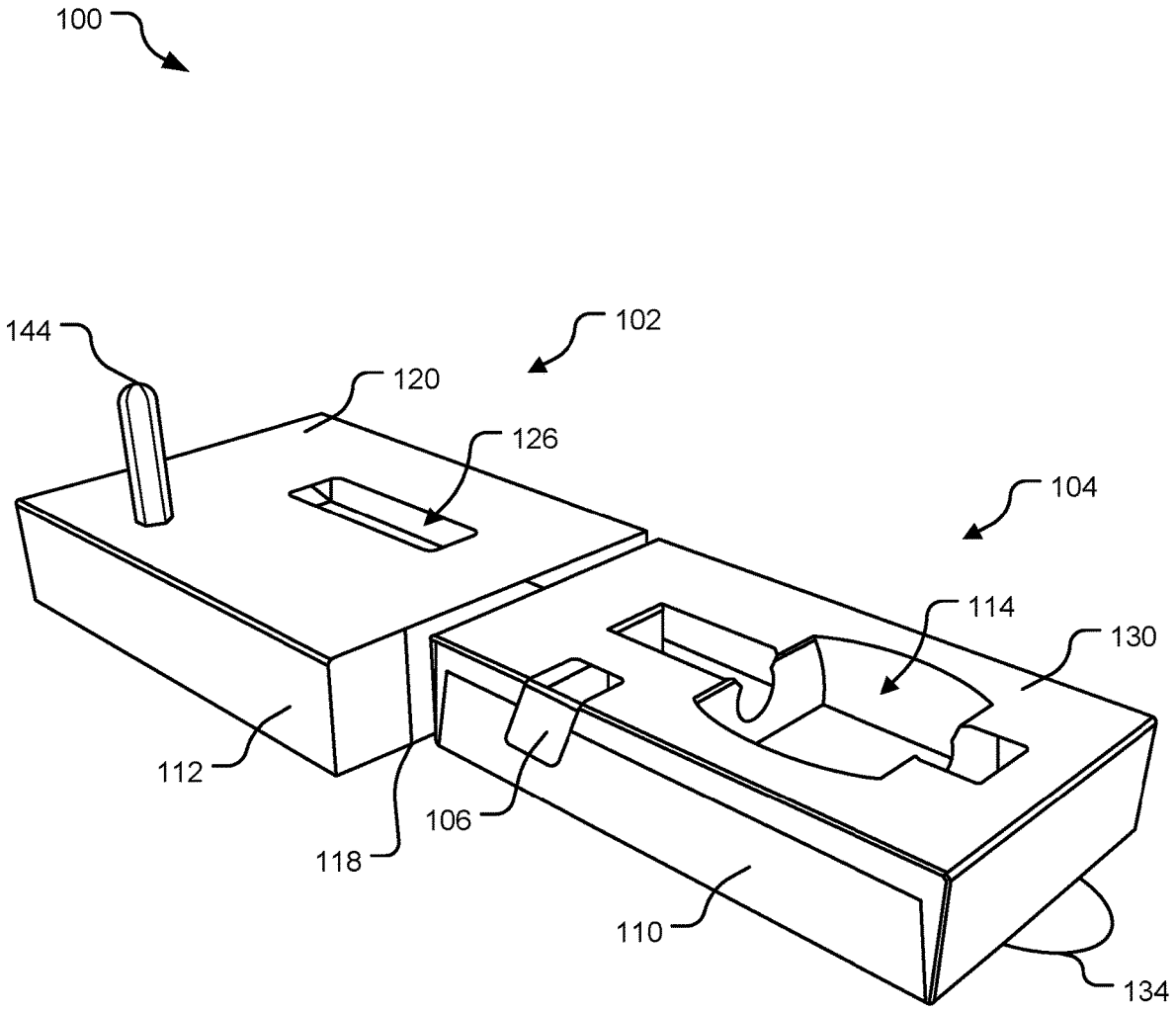
FIG. 1 illustrates a perspective view of an unassembled example packaging apparatus.

In the following description, for the purposes of explanation, numerous specific details are set forth in order to provide a thorough understanding of the present invention. It will be apparent, however, to one skilled in the art that the present invention may be practiced without some of these specific details.

For example, while various features are ascribed to particular implementations, it should be appreciated that the features described with respect to one implementation may be incorporated with some implementations as well. Similarly, however, no single feature or features of any described implementation should be considered essential to the invention, as some implementations of the invention may omit such features. For purposes of this disclosure, the term "substantially parallel" refers to a position wherein a tab lies sufficiently flat in relation to a first surface in an effort to slide between the first surface and a second surface opposing the first surface. For example, in some implementations, "substantially parallel" may be 0°-5° from the first surface. For purposes of this disclosure, the term "protruding" refers to a position wherein a tab extends from a first surface through an aperture in an effort to prevent movement and create a locking mechanism as the tab is trapped in the aperture. For example, in some implementations, "protruding" may mean a tab extends 10°-30° from the first surface. In some implementations, the tab may extend more than 10°-30°.

The disclosed technology includes a packaging apparatus configured to lock internally. The packaging apparatus may be referred to as a package, a carton, or an apparatus. The packaging apparatus may include two locking mechanisms, and be reusable, and relockable. In some implementations, the packaging apparatus may have at least one storage compartment or an insert containing a storage compartment to hold, store, and secure an item.

The disclosed packaging apparatus may comprise of different materials. In some implementations, some or all components of the packaging apparatus include at least one of a paperboard and plastic. In some implementations, the material may include a laminate, a laminated composition, or a layer of material laminated to another layer of material. In some implementations, the materials may be recyclable material.

In some implementations, the materials may be memory-inducing materials. For example, a tear-resistant film (e.g., a plastic) may be heat laminated (or glued) to a paperboard. Such composition may have memory-inducing properties and may be incorporated into certain components of the packaging apparatus (e.g., a tab or a flap). The plasticity of a tear-resistant laminate can cause a tab or flap component to move back to an original position after being pressed in a certain direction. In some implementations, there may be a tab or flap without memory-inducing properties.

In some implementations, a tab or flap may bend into and out of a locking position with a grain direction of the paperboard in the tab or flap. For example, the tab or flap bends and returns to a locked position with the grain direction of the paperboard, the grain direction being orthogonal to the fold line of the tab, and the fold line being parallel and aligned to the length of the inner sleeve (described in more detail in FIGS. 13C and D).

In some implementations, the packaging apparatus are child-resistant. Various standards exist for child-resistant packaging. For example, the Consumer Product Safety Commission's standards and protocols for poison prevention packaging, as set forth in the Code of Federal Regulations Title 16, Part 1700.20. Various embodiments of the present technology meet the standards for poison prevention packaging according to C.F.R. Title 16, Part 1700 for Poison Prevention Packaging.

Child-resistant packaging standards may also be found in the Federal Insecticide, Fungicide, and Rodenticide Act (FIFRA) section 25 (c)(3), located at 40 Code of Federal Regulations 157 subpart B. Additionally, standards development organizations such as American Society for Testing and Materials (ASTM) International develops and maintains standard test methods and procedures for child-resistant packages.

In some implementations, the packaging apparatus may be tamper-evident and/or senior-friendly. The packaging apparatus include panels, tabs, flaps, and apertures that may have various shapes (e.g., oval, rectangular, circular, etc.) depending on the intended use and manufacturing requirements (e.g., auto-erecting walls requirements). The panels, tabs, flaps, apertures, and other components of the packaging apparatus may have different locations in the packaging apparatus than what is shown in the figures. For example, a panel or tab may be moved in a packaging apparatus to accommodate better functioning of one of the disclosed locking mechanisms.

FIG. 1 illustrates a perspective view of an example packaging apparatus 100. The packaging apparatus 100 has an outer sleeve 102, an inner sleeve 104, and an interior sliding locking mechanism (described more below in detail) configured to lock the inner sleeve 104 inside the outer sleeve 102. In some implementations, there may be more than one locking mechanism.

In the implementation shown in FIG. 1, the sliding locking mechanism includes a tab 106 located on the inner sleeve 104. The tab 106 may have a springing mechanism where the tab 106 extends from the inner sleeve 104 in a resting condition, and when the tab 106 is pushed against a side 110 of the inner sleeve 104 and released, the tab 106 springs back in a preferred direction to a position extending from the inner sleeve 104.

The inner sleeve 104 has an inner sleeve storage compartment 114 on a front panel 130 for holding items in place, and for storing items in the outer sleeve 102. The inner sleeve storage compartment 114 can vary in design and shape depending on the design and use of the packaging apparatus 100, as well as the required design for desired items to be stored in the outer sleeve 102. For example, the inner sleeve storage compartment 114 may be designed to securely hold vials, bottles, a vape cartridge, electronic cigarettes, other objects, etc. in place. In some implementations, there may be multiple storage compartments 114.

Before the inner sleeve 104 is inserted into the outer sleeve 102 for locking, the tab 106 protrudes from an edge on the side 110 of the inner sleeve 104, as shown in FIG. 1. In order to insert the inner sleeve 104 into the outer sleeve 102, the tab 106 can be moved or depressed by an instrument or a user's finger toward the side 110 of the inner sleeve 104 until the tab 106 is substantially parallel or flush with the side 110 of the inner sleeve 104.

Once the tab 106 is substantially parallel or flush with the side 110 of the inner sleeve 104, the inner sleeve 104 may be inserted into the outer sleeve 102 in between two interior walls of the outer sleeve 102. In the implementation shown in FIG. 1, there is an interior wall 118 located approximately in between a side panel 112 of the outer sleeve 102 and the middle of the outer sleeve 102. In another implementation, one or both of the interior walls of the outer sleeve 102 may be on side panels 112 of the outer sleeve 102. In some implementations, the interior walls 118 may be located in other locations inside the outer sleeve 102.

The inner sleeve 104 may be inserted into the outer sleeve 102 in between interior walls of the outer sleeve 102 until the tab 106 locks into the outer sleeve 102. The locking mechanism can occur automatically when the tab 106 moves or springs into a first aperture (not shown in FIG. 1, see first aperture 216 in FIG. 2) in the interior wall 118 of the outer sleeve 102, and the tab 106 moves from a position parallel to the side of the inner sleeve 104 to a position perpendicular to the side 110 of the inner sleeve 104, locking the inner sleeve 104 in place inside the interior wall 118 of the outer sleeve 102. In some implementations, the locking mechanism may not occur automatically and may require manual assistance.

In FIG. 1, a second aperture (not shown) is located in the front panel 120 of the outer sleeve 102. In some implementations, a third aperture (see third aperture 224 in FIG. 2) may be located on a bottom panel (not shown) of the outer sleeve 102. An instrument or key 144 may be inserted into either the second aperture or a third aperture, to depress or push down on the tab 106 until it is flush or parallel with the side 110 of the inner sleeve 104 to unlock the inner sleeve 104 from the outer sleeve 102, and allow the inner sleeve 104 to slide out of the outer sleeve 102 while the instrument or key 144 is engaged. On FIG. 1, the instrument 144 is shown inserted in the second aperture, therefore the second aperture is not visible in FIG. 1. Once the inner sleeve 104 is removed from the outer sleeve 102, contents in the inner sleeve 104 are accessible. In some implementations, other apertures may be contemplated for access to the locking mechanism.

In the implementation shown in FIG. 1, a window 126 is located in the front panel 120 of the outer sleeve 102. The window 126 may be an aperture or a clear material (e.g., plastic or glass) for observation or visibility of items held in the inner sleeve storage compartment 114 on the front panel 130 of the inner sleeve 104. In some implementations, the inner sleeve 104 can be reversible and optionally be rotated 180° degrees and inserted into the outer sleeve 102 with the bottom panel (not shown) of the inner sleeve 104 observed through the window 126. In such implementations, when the inner sleeve 104 is locked in the outer sleeve 102, the tab 106 of the inner sleeve 104 will be parallel or flush with the bottom panel (not shown) of the outer sleeve 102. In order to unlock the inner sleeve 104, the instrument or key 144 may be inserted into a third aperture (e.g., third aperture 224 shown in FIG. 2) to depress or push down on the tab 106 until it is flush or parallel with the side 110 of the inner sleeve 104 to unlock the inner sleeve 104 from the outer sleeve 102, and allow the inner sleeve 104 to slide out of the outer sleeve 102.

In some implementations, as shown in FIG. 1, the inner sleeve 104 may have a pull tab 134 for easier insertion and removal of the inner sleeve 104 into and from the outer sleeve 102. In some implementations, a locking mechanism in the packaging apparatus 100 can include a spring, a key, and/or a magnet.

The components of the packaging apparatus 100 can comprise of one or more materials (i.e., paperboard, plastic, etc.). For example, in some implementations, all of the packaging apparatus 100 may be paperboard of varying thickness. In some implementations, the packaging apparatus 100 may be made of a plastic or laminate material. In some implementations, the packaging apparatus 100 may be made of a combination of materials, such as a combination of paperboard and laminate film.

In some implementations, the inner sleeve 104 and the outer sleeve 102 may be paperboard and the tab 106 may be plastic. In some implementations, the interior walls 118 of the outer sleeve 102 may have a lining or tray made of a material different than the outer sleeve 102. For example, the outer sleeve 102 may be made of paperboard, and a lining on the interior walls 118 of the outer sleeve 102 may be plastic or another material that cannot be ripped or torn, reinforcing the child-resistant nature of the packaging apparatus 100. Or in another implementation, the inner sleeve 104 may be made of both a plastic material and a paperboard material to provide additional durability. In some implementations, scoring of the tabs 106 may allow for memory, and different thicknesses of material may be used for rigidity. In some implementations, plastic laminate, a laminate film, or other tear-proof or tear-resistant material may be included in the packaging apparatus.

Figure 2:
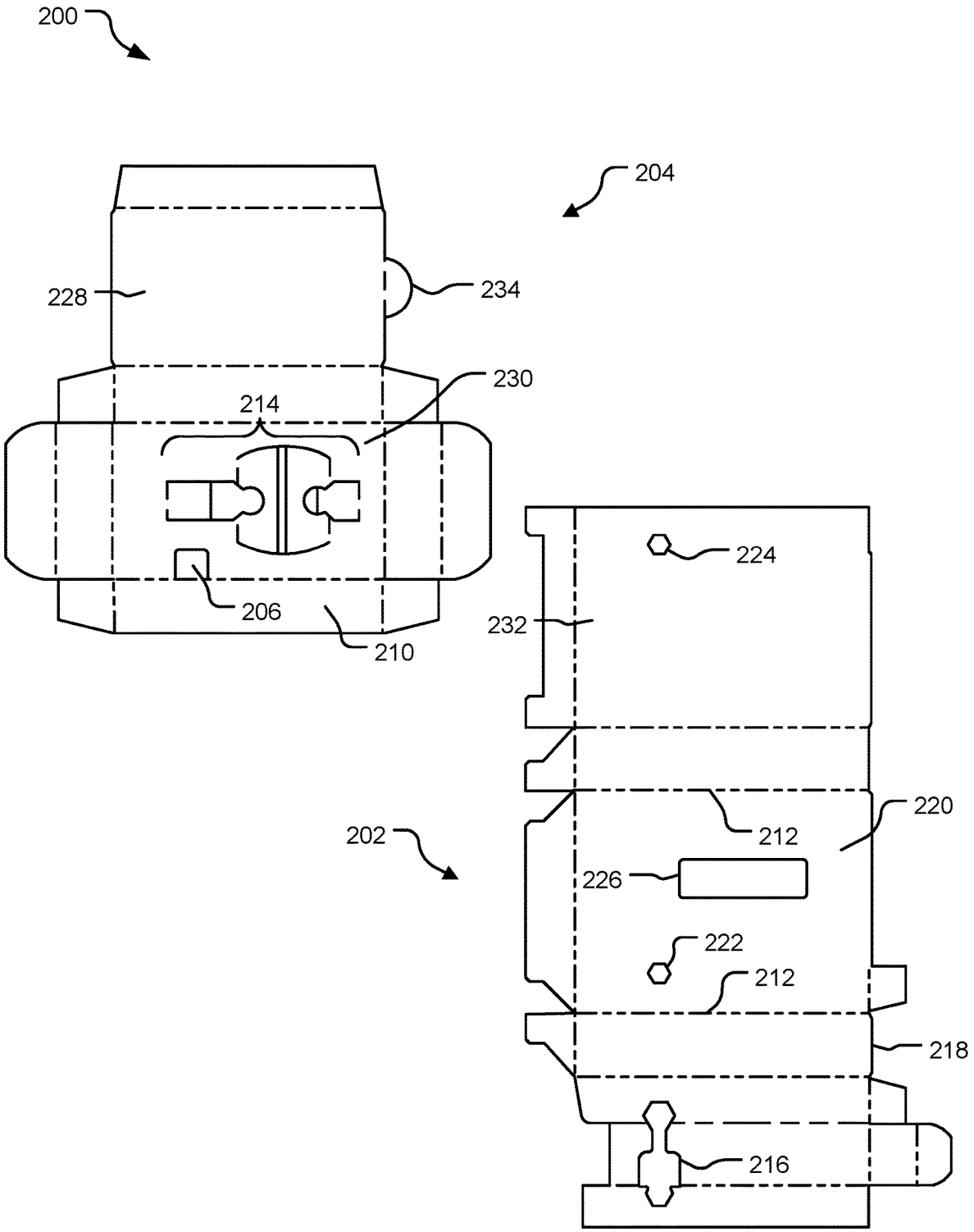
FIG. 2 illustrates a plan view of an unassembled example packaging apparatus.

FIG. 2 illustrates a side view of an unassembled example packaging apparatus 200, including an outer sleeve 202, an inner sleeve 204, and an interior sliding locking mechanism (described more below in detail) configured to lock the inner sleeve 204 inside the outer sleeve 202 once assembled. In this implementation, the sliding locking mechanism includes a tab 206 located on the inner sleeve 204.

The dashed lines in FIG. 2 depict where the material of the packaging apparatus may be folded when it is assembled. In some implementations, the dashed lines are perforated edges wherein panels, tabs, or flaps may fold. For example, a perforated edge may be where a panel, a tab, or a flap folds backwards against a surface (e.g., clay coating) of material (e.g., paperboard).

The inner sleeve 204 has an inner sleeve storage compartment 214 on a front panel 230 for holding items in place, and for storing items in a locked outer sleeve 202. The inner sleeve storage compartment 214 can vary depending on the design and use of the packaging apparatus 200, as well as the required design for desired items to be stored in the outer sleeve 202. For example, the inner sleeve storage compartment 214 may be designed to securely hold vials, bottles, electronic cigarettes, etc. in place. In some implementations, there may be multiple storage compartments 214.

Before the inner sleeve 204 is inserted into the outer sleeve 202 for locking, the tab 206 extends perpendicularly from an edge on the side of the inner sleeve 204. In order to insert the inner sleeve 204 into the outer sleeve 202, the tab 206 can be moved or depressed by an instrument or a user's finger toward the side 210 of the inner sleeve 204 until the tab 206 is substantially parallel or flush with the side 210 of the inner sleeve 204.

Once the tab 206 is substantially parallel or flush with the side 210 of the inner sleeve 204, the inner sleeve 204 may be inserted into the outer sleeve 202 in between two interior walls 218 of the outer sleeve 202. In the implementation shown in FIG. 2, there is an interior wall 218 located approximately in between a side panel 212 of the outer sleeve 202 and the middle of the outer sleeve 202. In another implementation, one or both of the interior walls 218 of the outer sleeve 202 may be on the side panel 212 of the outer sleeve 202. In some implementations, the interior walls 218 may be located in other locations inside the outer sleeve 202.

The inner sleeve 204 may be inserted into the outer sleeve 202 in between two interior walls until the tab 206 locks into the outer sleeve 202. The locking mechanism can occur automatically when the tab 206 moves into a first aperture 216 in the interior wall 218 of the outer sleeve, and the tab 206 moves from a position parallel to the side of the inner sleeve 204 to a position perpendicular to the side 210 of the inner sleeve 204, locking the inner sleeve 204 in place inside the interior wall 218 of the outer sleeve 202. In some implementations, the locking mechanism may not occur automatically and may require manual assistance.

In addition to locating in a position perpendicular to the side 210 of the inner sleeve 204, the tab 206 is now parallel or flush with the front panel 220 of the outer sleeve 202. In FIG. 2, a second aperture 222 is located in the front panel 220 of the outer sleeve 202, and a third aperture 224 is located on a bottom panel 232 of the outer sleeve 202. An instrument or key (not shown) may be inserted into either the second aperture 222 or the third aperture 224, to depress or push down on the tab 206 until it is flush or parallel with the side 210 of the inner sleeve 204 to unlock the inner sleeve 204 from the outer sleeve 202, and allow the inner sleeve 204 to slide out of the outer sleeve 202. Once the inner sleeve 204 is removed from the outer sleeve 202, contents in the inner sleeve 204 are accessible. In some implementations, other apertures may be contemplated for access to the locking mechanism.

In the implementation shown in FIG. 2, a window 226 is located in the front panel 220 of the outer sleeve 202. The window 226 may be an aperture or a clear material (e.g., plastic or glass) for observation of items held in the inner sleeve storage compartment 214 on the front panel 220 of the inner sleeve 204. In some implementations, the inner sleeve 204 can optionally be rotated 180° degrees and inserted into the outer sleeve 202 with a bottom panel 228 of the inner sleeve 204 observed through the window 226. In such implementations, when the inner sleeve 204 is locked in the outer sleeve 202, the tab 206 of the inner sleeve 204 will be parallel or flush with a bottom panel 232 of the outer sleeve 202. In order to unlock the inner sleeve 204, an instrument or key (not shown) may be inserted into the third aperture 224 to depress or push down on the tab 206 until it is flush or parallel with the side 210 of the inner sleeve 204 to unlock the inner sleeve 204 from the outer sleeve 202, and allow the inner sleeve 204 to slide out of the outer sleeve 202.

In some implementations, as shown in FIG. 2, the inner sleeve 204 may have a pull tab 234 for easier insertion and removal of the inner sleeve 204 into and from the outer sleeve 202. In some implementations, a locking mechanism in the packaging apparatus 200 can include a spring, a key and/or a magnet.

The components of the packaging apparatus 200 can comprise of one or more materials (i.e., paperboard, plastic, etc.). For example, in some implementations, all of the packaging apparatus 200 may include paperboard of varying thickness. In some implementations, the inner sleeve 204 and the outer sleeve 202 may be paperboard and the tab 206 may be plastic. In some implementations, the interior walls 218 of the outer sleeve 202 may have a lining made of a material different than the outer sleeve 202. For example, the outer sleeve 202 may be made of paperboard, and a lining on the interior walls of the outer sleeve 202 may be plastic or another material that has resistance to being ripped or torn, reinforcing the child-resistant nature of the packaging apparatus 200.

Figure 3:
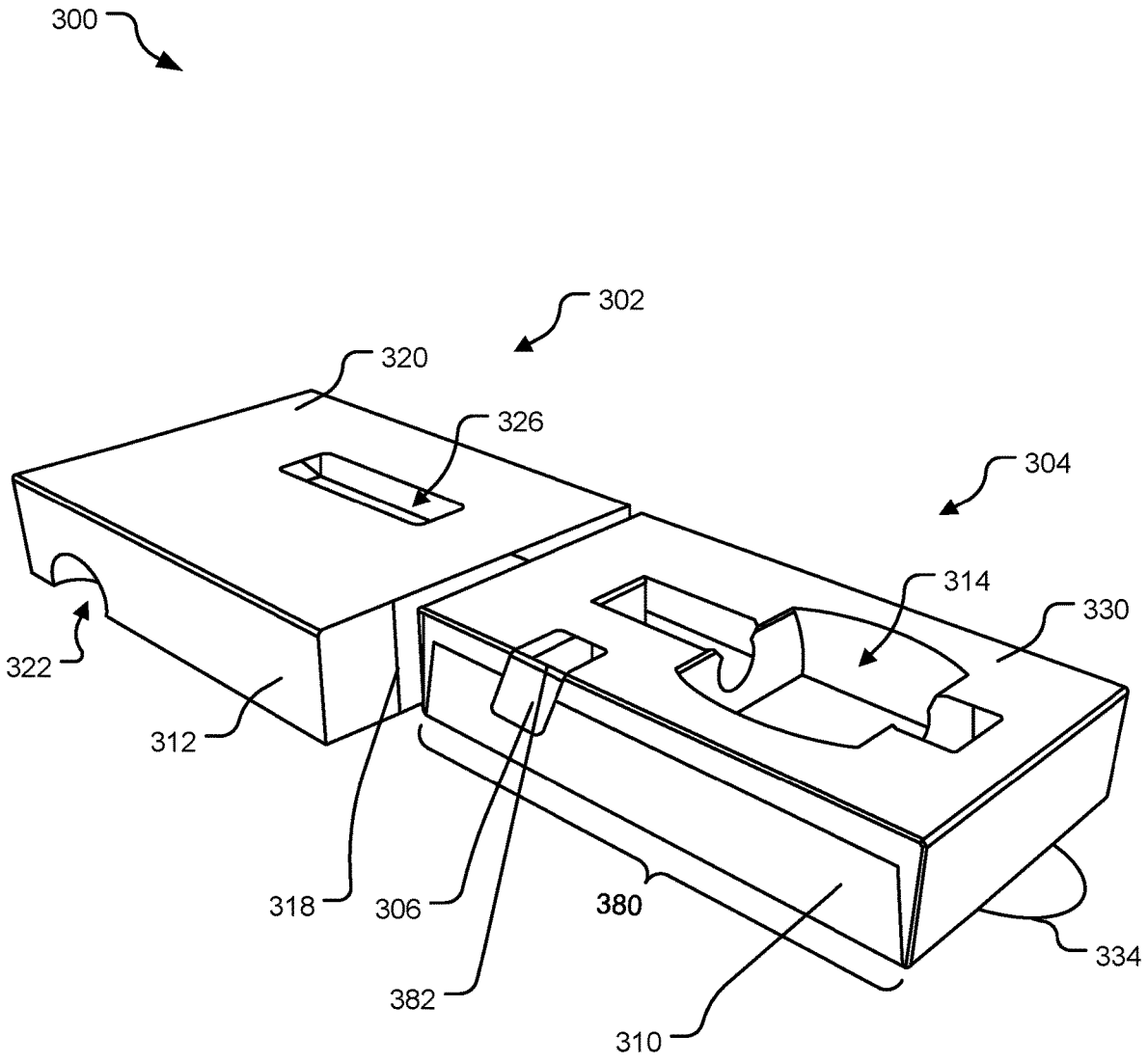
FIG. 3 illustrates a perspective view of an example unassembled packaging apparatus.

FIG. 3 illustrates a perspective view of an example packaging apparatus 300. The packaging apparatus 300 has an outer sleeve 302, an inner sleeve 304, and an interior sliding locking mechanism (described more below in detail) configured to lock the inner sleeve 304 inside the outer sleeve 302. In this implementation, the sliding locking mechanism includes a tab 306 located on the inner sleeve 304.

The inner sleeve 304 has an inner sleeve storage compartment 314 on a front panel 330 for holding items in place, and for storing items in a locked outer sleeve 302. The inner sleeve storage compartment 314 can vary depending on the design and use of the packaging apparatus 300, as well as the required design for desired items to be stored in the outer sleeve 302. For example, the inner sleeve storage compartment 314 may be designed to securely hold vials, bottles, electronic cigarettes, etc. in place. In some implementations, there may be multiple storage compartments 314.

Before the inner sleeve 304 is inserted into the outer sleeve 302 for locking, the tab 306 extends perpendicularly from an edge on the side of the inner sleeve 304, as shown in FIG. 3. In order to insert the inner sleeve 304 into the outer sleeve 302, the tab 306 can be moved or depressed by an instrument or a user's finger toward the side 310 of the inner sleeve 304 until the tab 306 is substantially parallel or flush with the side 310 of the inner sleeve 304.

Once the tab 306 is substantially parallel or flush with the side 310 of the inner sleeve 304, the inner sleeve 304 may be inserted into the outer sleeve 302 in between two interior walls of the outer sleeve 302. In the implementation shown in FIG. 3, there is an interior wall 318 located approximately in between a side panel 312 of the outer sleeve 302 and the middle of the outer sleeve 302. In another implementation, one or both of the interior walls of the outer sleeve 302 may be on side panels 312 of the outer sleeve 302. In some implementations, the interior walls may be located in other locations inside the outer sleeve 302.

The inner sleeve 304 may be inserted into the outer sleeve 302 in between two interior walls until the tab 306 locks into the outer sleeve 302. The locking mechanism can occur automatically when the tab 306 moves into a first aperture (not shown in FIG. 3, see first aperture 216 in FIG. 2) in the interior wall 318 of the outer sleeve 302, and the tab 306 moves from a position parallel to the side of the inner sleeve 304 to a position perpendicular to the side 310 of the inner sleeve 304, locking the inner sleeve 304 in place inside the interior wall 318 of the outer sleeve 302. In some implementations, the locking mechanism may not occur automatically and may require manual assistance.

In addition to locating in a position perpendicular to the side 310 of the inner sleeve 304, the tab 306 is now parallel or flush with the front panel 320 of the outer sleeve 302. In FIG. 3, a second aperture 322 is located in the bottom panel (not shown) and on a side panel 312 of the outer sleeve 302. An instrument or key (not shown) may be inserted into second aperture 322, to depress or push down on the tab 306 until it is flush or parallel with the side 310 of the inner sleeve 304 to unlock the inner sleeve 304 from the outer sleeve 302, and allow the inner sleeve 304 to slide out of the outer sleeve 302. Once the inner sleeve 304 is removed from the outer sleeve 302, contents in the inner sleeve 304 are accessible. In some implementations, other apertures may be contemplated for access to the locking mechanism.

In some implementations, the first tab 306 may bend into and out of a locking position with a grain direction of the paperboard in the first tab 306. For example, the first tab 306 bends and returns to a locked position with the grain direction of the paperboard, the grain direction being orthogonal to the fold line 382 of the first tab 306, and the fold line 382 being parallel and aligned to the length 380 of the inner sleeve.

In the implementation shown in FIG. 3, a window 326 is located in the front panel 320 of the outer sleeve 302. The window 326 may be an aperture or a clear material (e.g., a plastic or a glass) for observation of items held in the inner sleeve storage compartment 314 on the front panel 330 of the inner sleeve 304.

In some implementations, as shown in FIG. 3, the inner sleeve 304 may have a pull tab 334 for easier insertion and removal of the inner sleeve 304 into and from the outer sleeve 302. In some implementations, a locking mechanism in the packaging apparatus 300 can include a spring, a key, and/or a magnet.

The components of the packaging apparatus 300 can comprise of one or more materials (i.e., paperboard, plastic, etc.). For example, in some implementations, the packaging apparatus 300 may be paperboard of varying thickness. In some implementations, the inner sleeve 304 and the outer sleeve 302 may be paperboard and the tab 306 may be plastic. In some implementations, the interior walls of the outer sleeve 302 may have a lining made of a material different than the outer sleeve. For example, the outer sleeve 302 may be made of paperboard, and a lining on the interior walls of the outer sleeve may be plastic or another material that cannot be ripped or torn, reinforcing the child-resistant nature of the packaging apparatus 300.

Figure 4:
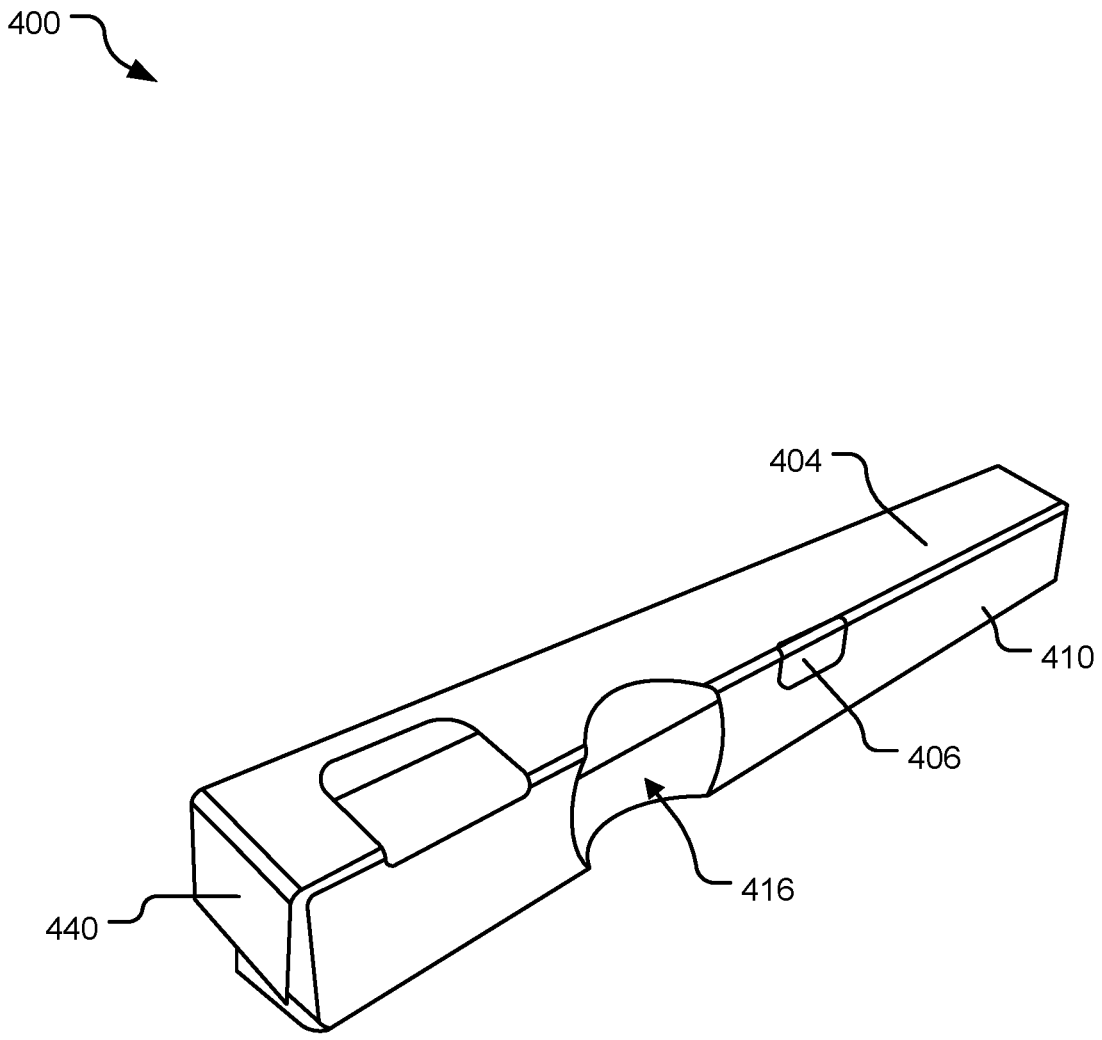
FIG. 4 illustrates a perspective view of an example assembled packaging apparatus.

FIG. 4 illustrates a perspective view of an example packaging apparatus 400. The packaging apparatus 400 has an outer sleeve (not shown), an inner sleeve 404, and an exterior sliding locking mechanism (described more below in detail) configured to lock the inner sleeve 404 inside the outer sleeve. In some implementations, there may be more than one locking mechanism.

A dog-eared tuck 440 on the end of the inner sleeve 404 is permanently fixed, and requires tearing to open the packaging apparatus 400. In some implementations, there may packaging apparatus with one or more permanently fixed tucks.

In this implementation, the inner sleeve 404 itself holds items in place and stores items. The inner sleeve 404 can vary depending on the design and use of the packaging apparatus 400, as well as the required design for desired items to be stored in the inner sleeve 404. For example, the inner sleeve 404 may be designed to be a rectangular sleeve or have attachments or storage compartments to securely hold vials, bottles, electronic cigarettes, etc. in place. In some implementations, there may be multiple storage compartments.

The components of the packaging apparatus 400 can comprise of one or more materials (i.e., paperboard, plastic, etc.). For example, in some implementations, all the packaging apparatus 400 may be paperboard of varying thickness. In some implementations, the inner sleeve 404 and the outer sleeve may be paperboard and/or plastic. In some implementations, the interior walls of the outer sleeve may have a lining made of a material different than the outer sleeve. For example, the outer sleeve may be made of paperboard, and a lining on the interior walls of the outer sleeve may be plastic or another material that cannot be ripped or torn, reinforcing the child-resistant nature of the packaging apparatus 400.

In this implementation, the inner sleeve 404 has ears (not shown) that are connected to the tuck 440 to facilitate the locking mechanism. The ears can be folded against the tuck 440. There are dust flaps attached to the tuck 440 that can be pushed into the inner sleeve 404 prior to closing the tuck 440 into the inner sleeve 404. The flaps can be pushed into the inner sleeve 404. An inside flap can move inside the inner sleeve 404 to keep the tuck 440 from backing out of position.

When inserting the inner sleeve 404 into the outer sleeve, a locking tab located on the outer sleeve needs to be folded inside the outer sleeve. When the inner sleeve 404 is inserted into the outer sleeve, a tab or internal tab 406 located on the inner sleeve 404 can be moved or depressed toward a side 410 of the inner sleeve 404 until the tab 406 is substantially parallel or flush with the side 410 of the inner sleeve 404. As the inner sleeve 404 is pushed or slides into the outer sleeve, the locking tab located on the outer sleeve moves into an aperture (not shown) on the inner sleeve 404. In this implementation, the packaging apparatus 400 cannot be unlocked. To open the packaging apparatus 400, the packaging apparatus 400 must be torn open.

A window 416 may be an aperture or a clear material (e.g., plastic or glass) for observation or visibility of items held in the packaging apparatus 400. In some implementations, the inner sleeve 404 can be reversible and optionally be rotated 180° degrees and inserted into the outer sleeve with a bottom panel of the inner sleeve 404 observed through the window 416.

Figure 5:
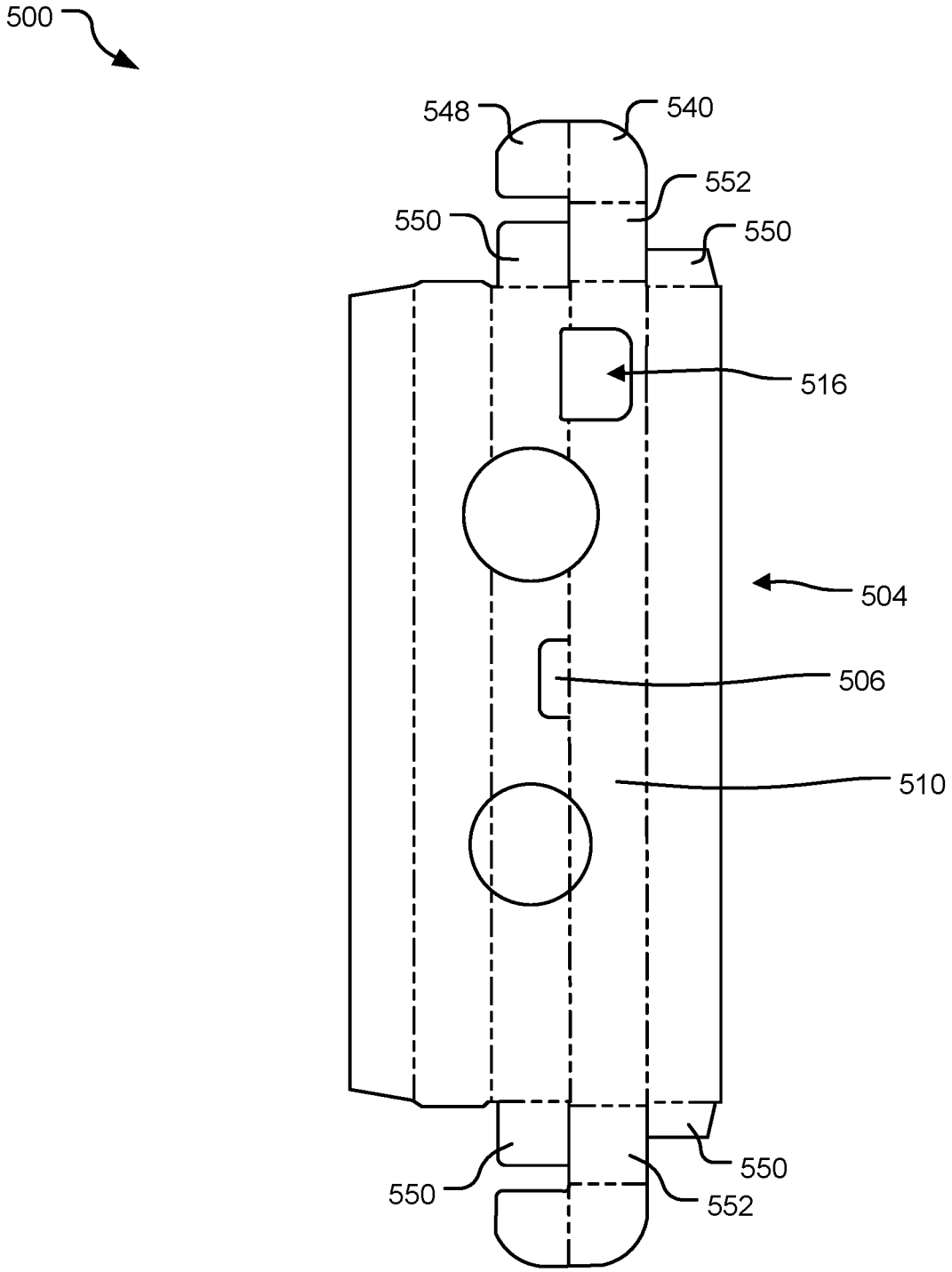
FIG. 5 illustrates a plan view of an example unassembled inner sleeve of a packaging apparatus.

FIG. 5 illustrates a side view of an unassembled example inner sleeve 500 of a packaging apparatus. The inner sleeve 500 has a sliding locking mechanism (described more below in detail) configured to lock the inner sleeve 500 inside an outer sleeve (not shown). The dashed lines in FIG. 5 depict where the material of the inner sleeve 500 may be folded when it is assembled. In some implementations, there may be more than one locking mechanism.

In some implementations, a dog-eared tuck 540 on the end of the inner sleeve 500 may be permanently fixed, and requires tearing to open the packaging apparatus 500. In some implementations, there may packaging apparatus with one or more permanently fixed tucks.

In this implementation, the inner sleeve 500 itself holds items in place and stores items. The inner sleeve 500 can vary depending on the design and use of the packaging apparatus, as well as the required design for desired items to be stored in the inner sleeve 500. For example, the inner sleeve 500 may be designed to be a rectangular sleeve or have attachments or storage compartments to securely hold vials, bottles, electronic cigarettes, etc. in place. In some implementations, there may be multiple storage compartments.

The components of the packaging apparatus can comprise of one or more materials (i.e., paperboard, plastic, etc.). For example, in some implementations, all the packaging apparatus may be paperboard of varying thickness. In some implementations, the inner sleeve 500 and the outer sleeve may be paperboard and/or plastic. In some implementations, the interior walls of the inner sleeve may have a lining made of a material different than the outer sleeve. For example, the inner sleeve may be made of paperboard, and a lining on the interior walls of the outer sleeve may be plastic or another material that cannot be ripped or torn, reinforcing the child-resistant nature of the packaging apparatus.

In this implementation, the inner sleeve 500 has ears 548 that are connected to the tuck 540 to facilitate the locking mechanism. The ears can be folded against the tuck 540. There are dust flaps 550 attached to the tuck 540 that can be pushed into the inner sleeve 500 prior to closing the tuck 540 into the inner sleeve 500. Tuck flaps 552 attached to the tuck 540 can be pushed into the inner sleeve 500. The ears 548 can move inside the inner sleeve 500 to keep the tuck 440 from backing out of position.

When inserting the inner sleeve 500 into the outer sleeve, a locking tab located on the outer sleeve needs to be folded inside the outer sleeve. When the inner sleeve 500 is inserted into the outer sleeve, a tab 506 located on the inner sleeve 500 can be moved or depressed toward a panel 510 of the inner sleeve 500 until the tab 506 is substantially parallel or flush with the panel 510 of the inner sleeve 500. As the inner sleeve 500 is pushed or slides into the outer sleeve, the locking tab located on the outer sleeve moves into an aperture 516 on the inner sleeve 500. In this implementation, the packaging apparatus cannot be unlocked. To open the packaging apparatus, the packaging apparatus must be torn open.

Figure 6:
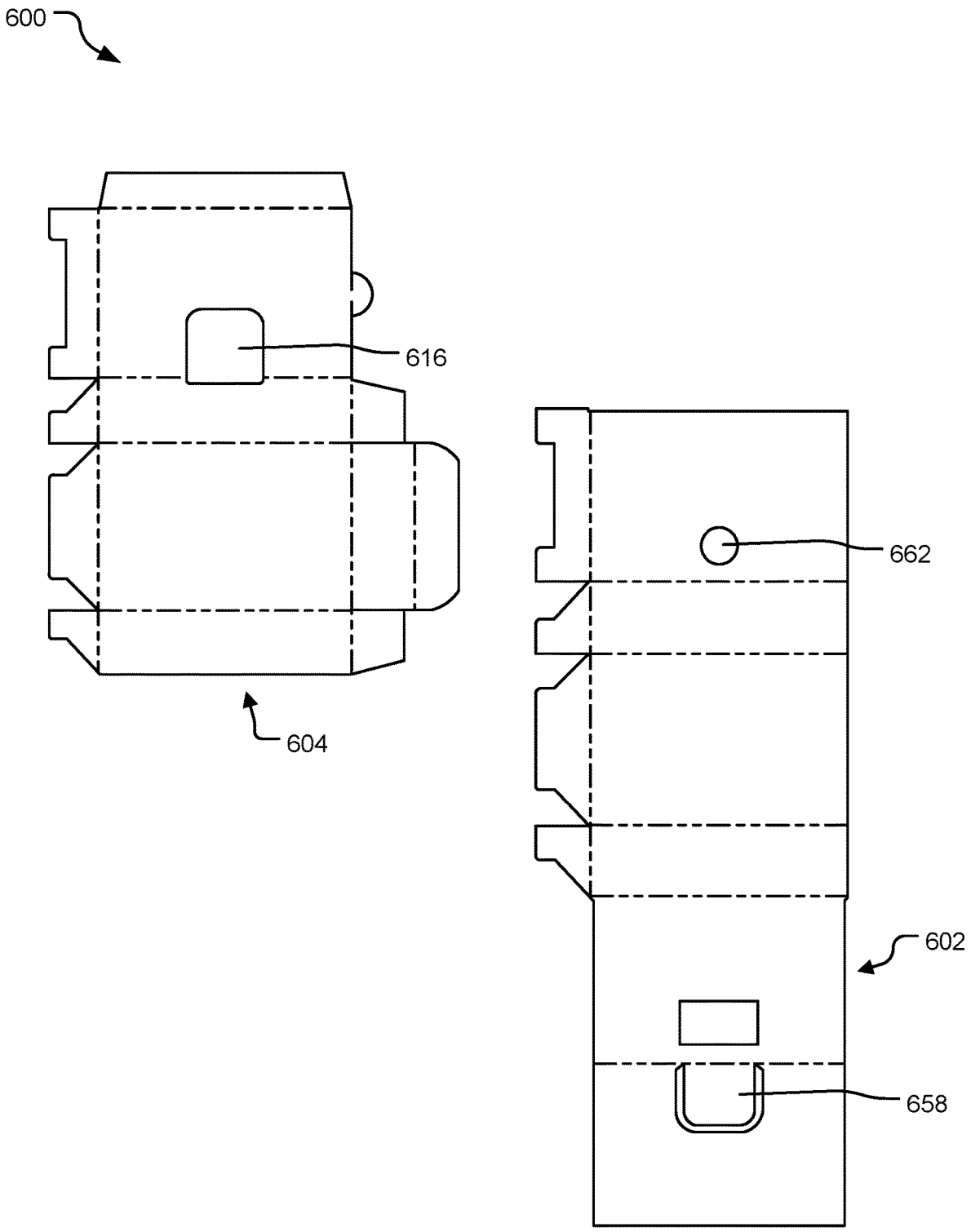
FIG. 6 illustrates a plan view of an unassembled example packaging apparatus.

FIG. 6 illustrates a side view of an unassembled example packaging apparatus 600. The packaging apparatus 600 has an outer sleeve 602, an inner sleeve 604, and an interior sliding locking mechanism (described more below in detail) configured to lock the inner sleeve 604 inside the outer sleeve 602. In some implementations, there may be more than one locking mechanism. The dashed lines in FIG. 6 depict where the material of the packaging apparatus may be folded when it is assembled.

In the implementation shown in FIG. 6, the sliding locking mechanism includes a metal disc (not shown) affixed to a component 658 in the outer sleeve 602. The component 658 has memory, like the tabs 106, 206, 306, for example, in FIGS. 1-3, and falls into a preferred position if no external force is exhibited. The preferred positioning of the component 658 acts as a "lock" for the packaging apparatus 600 by locating the component 658 into an aperture 616 in the inner sleeve 604, and causing friction or obstruction preventing movement of the inner sleeve 604 out of the outer sleeve 602.

A marked location 662 on the outer sleeve 602 indicates a position corresponding to the lock in the interior of the outer sleeve 602, upon which a magnet key or instrument can be placed and moved to unlock the packaging apparatus 600. The packaging apparatus is unlocked when the magnet key moves across the surface of the outer sleeve 602 from the marked location 662, pulling or moving the component 658 of the outer sleeve 602 out of the aperture 616 of the inner sleeve. Once the packaging apparatus is unlocked, the inner sleeve 604 can be removed from the outer sleeve 602.

Depending on the implementation, the magnet locking mechanism may be located on various sides of the packaging apparatus 600 (i.e., top panel, side panel, etc.). In some implementations, the inner sleeve 604 can be reversible, or optionally rotated 180° degrees, as described in FIG. 1.

In some implementations, the inner sleeve 604 has a storage compartment for holding items in place, and for storing items. The storage compartment can vary depending on the design and use of the packaging apparatus 600, as well as the required design for desired items to be stored. For example, the storage compartment may be designed to securely hold vials, bottles, electronic cigarettes, etc. in place. In some implementations, there may be multiple storage compartments. In this implementation, there is no separate storage compartment.

The components of the packaging apparatus 600 can comprise of one or more materials (i.e., paperboard, plastic, etc.). For example, in some implementations, all the packaging apparatus 600 may be paperboard of varying thickness. In some implementations, the tab (not shown) may be plastic and the remaining components of the inner sleeve 604 and the outer sleeve 602 may be paperboard. In some implementations, the interior walls of the outer sleeve 602 may have a lining or tray made of a material different than the outer sleeve. For example, the outer sleeve 602 may be made of paperboard, and a lining on the interior walls of the outer sleeve may be plastic or another material that cannot be ripped or torn, reinforcing the child-resistant nature of the packaging apparatus 600. Or in another implementation, the inner sleeve 604 may be made of both a plastic material and a paperboard material to provide additional durability. In some implementations, scoring of the tabs may allow for memory, and different thicknesses of material may be used for rigidity. In some implementations, plastic laminate, a laminate film, or other tear-proof or tear-resistant material may be included in the packaging apparatus.

FIGS. 7A-F illustrates a perspective view of an example packaging apparatus 700. As shown in FIGS. 7A-F, the packaging apparatus 700 has an outer sleeve 702 and an inner sleeve 704. The dashed lines in FIGS. 7A-F depict where the material of the packaging apparatus may be folded when it is assembled. The packaging apparatus 700 has two locking mechanisms (shown and described more below in detail) configured to lock the inner sleeve 704 inside the outer sleeve 702. In other implementations, there may be one locking mechanism or multiple locking mechanisms.

Figure 7A:
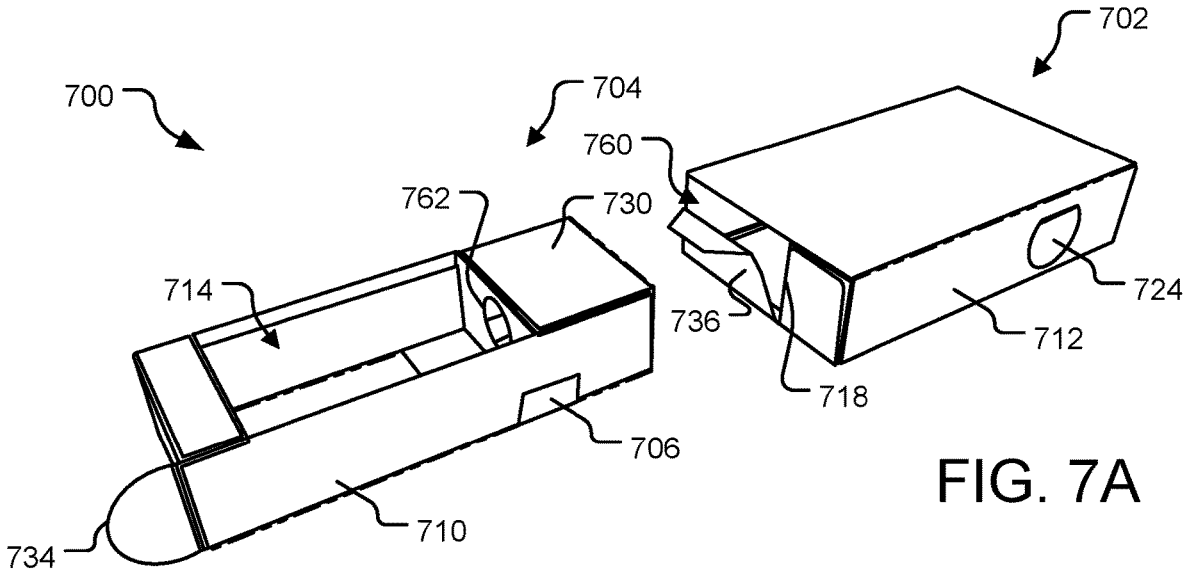
FIGS. 7A-F illustrates perspective views of an example packaging apparatus during use.

In the implementation shown in FIG. 7A, a first locking mechanism is an interior sliding locking mechanism, which includes a first tab 706 located on the inner sleeve 704. The first tab 706 may have a springing mechanism where the first tab 706 extends from the inner sleeve 704 in a resting condition, and when the first tab 706 is pushed against a side panel 710 of the inner sleeve 704 substantially parallel to the side panel 710 and released, the first tab 706 springs back in a preferred direction to a position extending from the inner sleeve 704.

The inner sleeve 704 has an inner sleeve storage compartment 714 on a front panel 730 for holding items in place, and for storing items in the outer sleeve 702. The inner sleeve storage compartment 714 can vary in design and shape depending on the design and use of the packaging apparatus 700, as well as the required design for desired items to be stored. For example, in some implementations, an aperture 762 is located in the inner sleeve storage compartment 714 for loading a longer cylindrical or another shaped item into the inner sleeve 704. The item may enter the aperture 762 and extend into the inner sleeve 704 in an outer sleeve compartment (not shown) beyond the inner sleeve storage compartment 714.

In some implementations, an insert may be designed for inserting into the inner sleeve storage compartment 714 configured to hold a desired item. For example, the inner sleeve storage compartment 714 or an insert designed to be inserted in the inner sleeve storage compartment 714 may be designed to securely hold vials, bottles, a vape cartridge, electronic cigarettes, other objects, etc. in place. In some implementations, there may be multiple compartments 714 or multiple inserts.

Before the inner sleeve 704 is inserted into the outer sleeve 702, the first tab 706 extends outward from an edge on the side panel 710 of the inner sleeve 704, as shown in FIG. 7A. To insert the inner sleeve 704 into the outer sleeve 702, the first tab 706 can be moved or depressed by an instrument or a user's finger toward the side panel 710 of the inner sleeve 704 until the first tab 706 is substantially parallel or flush with the side panel 710 of the inner sleeve 704.

Once the first tab 706 is substantially parallel or flush with the side panel 710 of the inner sleeve 704, the inner sleeve 704 may be inserted into the outer sleeve 702. In the implementation shown in FIG. 7A, there is an interior wall 718 between an open outer sleeve compartment 760 and a closed outer sleeve compartment 738 (shown in FIG. 7E). In some implementations, there may be more than one interior wall in the outer sleeve 702. In some implementations, the interior wall 718 may be located in other locations inside the outer sleeve 702.

The inner sleeve 704 may be inserted into the open outer sleeve compartment 760 until the first tab 706 locks into the outer sleeve 702. The locking mechanism can occur automatically when the first tab 706 moves or springs into a first aperture 716 (shown in FIG. 7E) in the interior wall 718 of the outer sleeve 702. The first tab 706 may move in a range of positions, for example, from a position substantially parallel to the side of the inner sleeve 704 to a position protruding from the side panel 710 of the inner sleeve 704, extending through the first aperture 716 locking the inner sleeve 704 in place inside the interior wall 718 of the outer sleeve 702. In some implementations, the locking mechanism may not occur automatically and may require manual assistance.

In FIG. 7A, a first flap 724 is located in the first side panel 712 of the outer sleeve 702. A user's finger, instrument or key (not shown) may depress the first flap 724 into the closed outer sleeve compartment 738 of the outer sleeve 702. Moving the first flap 724 into the closed outer sleeve compartment 738 provides access for a user to depress or push the first tab 706. The first tab 706 may be moved from a position protruding from the side panel of the inner sleeve to a position substantially parallel to the side panel of the inner sleeve inside the closed outer sleeve compartment 738, and through the first aperture 716, to unlock the inner sleeve 704 from the outer sleeve 102, and allow the inner sleeve 704 to slide out of the outer sleeve 702 while the user's finger, an instrument or a key is engaged. Once the inner sleeve 704 slides out of the outer sleeve 702, contents in the inner sleeve 704 are accessible. In some implementations, other apertures may be contemplated for access to the locking mechanism.

In some implementations, a second locking mechanism (described in more detail in FIGS. 11A-F) also locks the inner sleeve 704 in the outer sleeve 702. The second locking mechanism is located between an exterior surface of a bottom panel of the inner sleeve 704 and the interior surface of the bottom panel of the outer sleeve 702, and permits the inner sleeve 704 to be removed partially out of the outer sleeve 702 but does not permit the inner sleeve 704 to be removed entirely out of the outer sleeve 702.

One component used in the second locking mechanism is a second tab 736 connected to a bottom panel of the outer sleeve 702 shown in FIG. 7A. The second tab 736 may be folded down inside the outer sleeve 702 before the inner sleeve 704 is inserted into the open outer sleeve compartment 760. A third tab (not shown) is connected to a bottom panel of the inner sleeve 704 and may be folded down under the inner sleeve 704 to a position substantially parallel to an exterior surface of the bottom panel before the inner sleeve 704 is inserted into the outer sleeve 702. A second flap (not shown) is located in the bottom panel of the inner sleeve 704 and opens into the inner sleeve 704 creating an aperture (not shown). When the inner sleeve 704 is pulled out of the outer sleeve 702, the second tab 736 moves into the aperture in the bottom panel of the inner sleeve 704 and contacts the third tab. In response to the second tab 736 contacting the third tab, the second tab 736 moves out of the aperture and inner sleeve 704 and back into the outer sleeve 702 becoming lodged between the third tab and the exterior surface of the bottom panel of the inner sleeve, facilitating the locking mechanism of the packaging apparatus 700.

In some implementations, as shown in FIG. 7A, the inner sleeve 704 may have a pull tab 734 for easier insertion and removal of the inner sleeve 704 into and out of the outer sleeve 702. In some implementations, a locking mechanism in the packaging apparatus 100 can include a spring, a key, and/or a magnet.

Figure 7B:
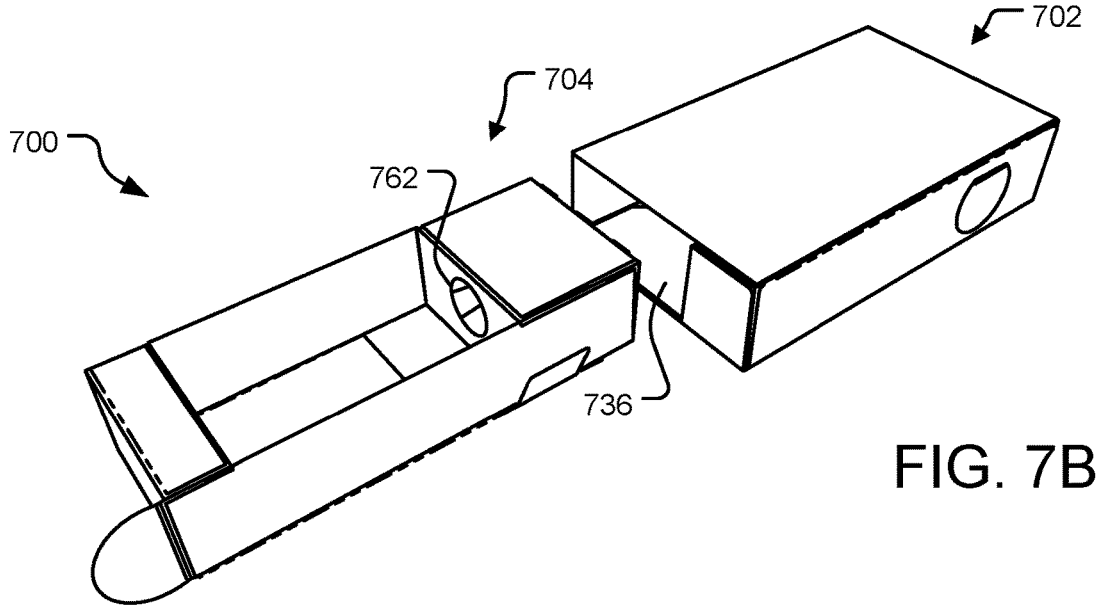

FIG. 7B illustrates the second tab 736 folded down inside the open outer sleeve compartment 760 of the packaging apparatus 700. Once the second tab 736 is folded down inside the outer sleeve 702, the inner sleeve 704 may be inserted into the outer sleeve 702.

Figure 7C:
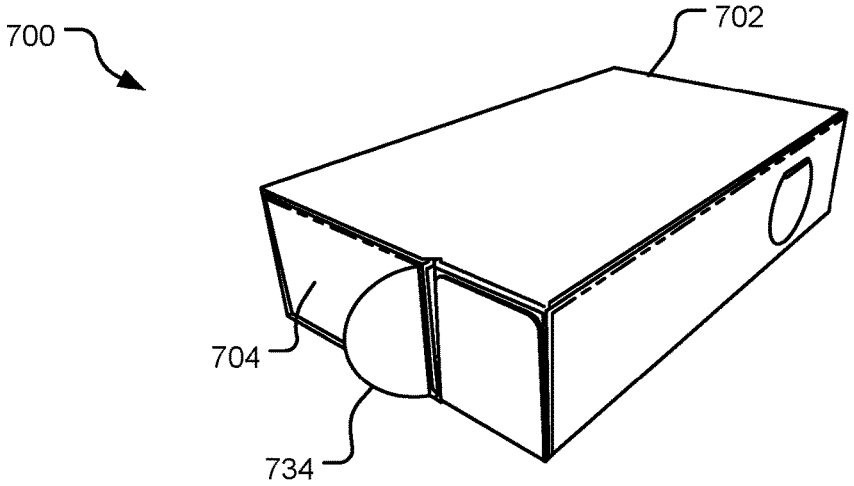

FIG. 7C illustrates the inner sleeve 704 fully inserted into the outer sleeve 702 in a closed packaging apparatus 700. The pull tab 734 is shown extending from the inner sleeve 704 for insertion and removal of the inner sleeve 704 into and from the outer sleeve 702.

Figure 7D:
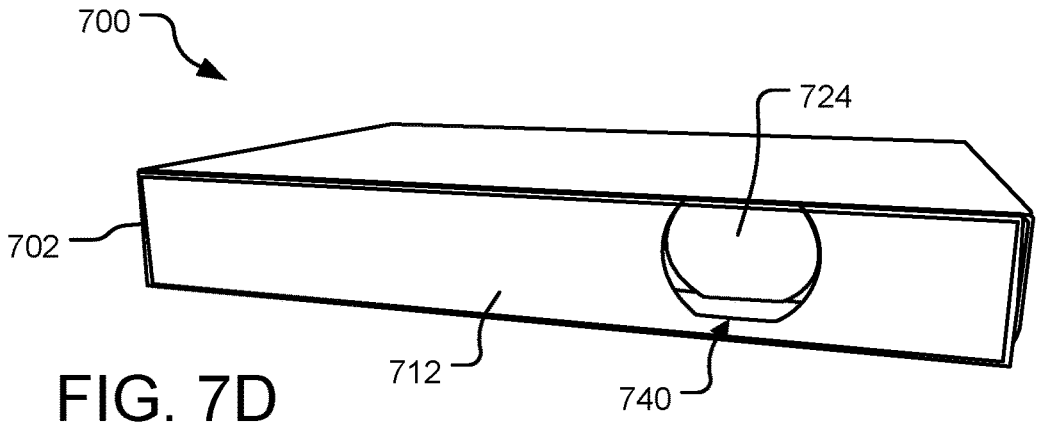

FIG. 7D illustrates the inner sleeve 704 fully inserted into the outer sleeve 702 in a closed packaging apparatus 700. A flap 724 is located in the first side panel 712 of the outer sleeve 702. A user can press on the flap 724 and push the flap 724 into a closed outer sleeve compartment (not shown) inside the outer sleeve 702, creating a second aperture 740 for access to the first tab 706 in the first locking mechanism.

Figure 7E:
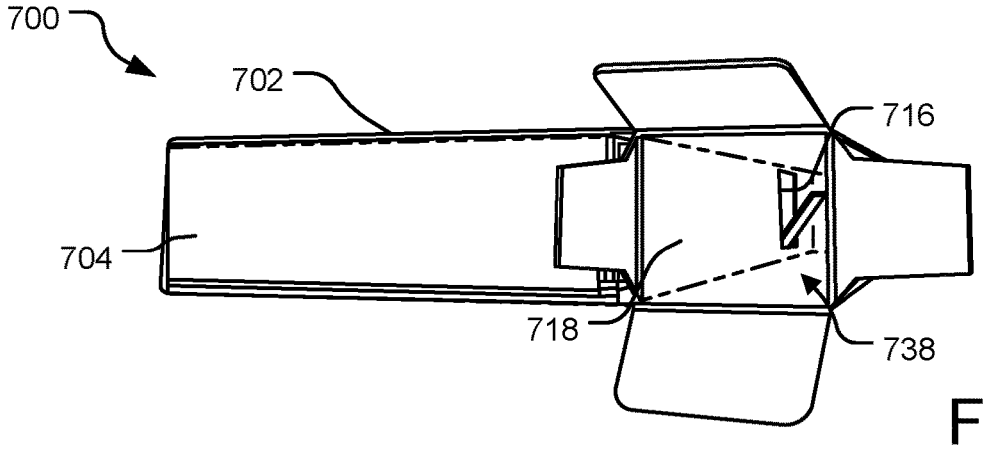

FIG. 7E illustrates an interior view of the closed outer sleeve compartment 738 inside the outer sleeve 702 located between the interior wall 718 of the inner sleeve 704 and the side panel (not shown) of the outer sleeve 702. In FIG. 7E, the first tab 706 is shown extending from the inner sleeve 704 through a first aperture 716 in the interior wall 718 of the outer sleeve 702. The first tab 706 is configured to move in a range of positions, from a position parallel to the side of the inner sleeve 704 to a position perpendicular to the side of the inner sleeve 704. When the first tab 706 is in a position extending through the first aperture 716 and into the closed outer sleeve compartment 738, the inner sleeve 704 is locked in the outer sleeve 702. When a user presses the first tab 706 to a position parallel to the side of the inner sleeve 704 and through the first aperture 716, the user can unlock the packaging apparatus 700 and slide the inner sleeve 704 out of the outer sleeve 702, opening the packaging apparatus 700.

Figure 7F:
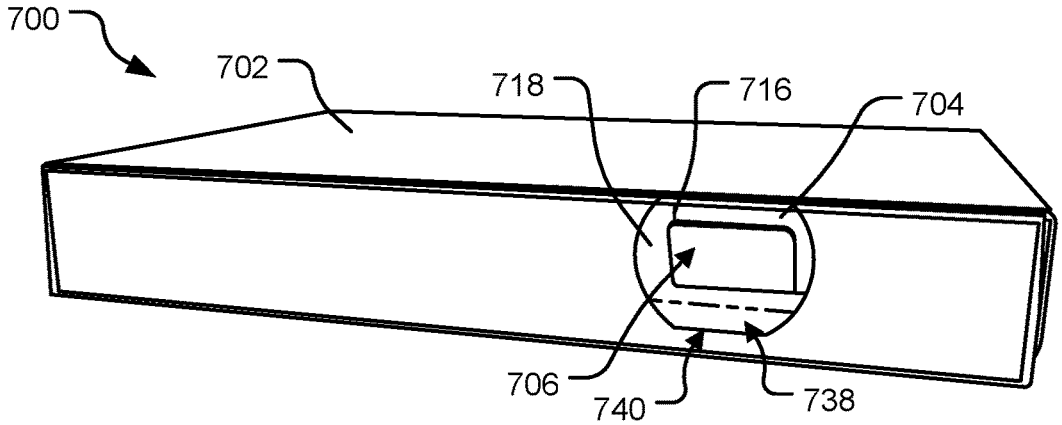

FIG. 7F illustrates a view through the second aperture 740 into the closed outer sleeve compartment 738 inside the outer sleeve 702. In FIG. 7F, the first tab 706 is shown extending from the inner sleeve 704 through the first aperture 716 in the interior wall 718 of the outer sleeve 702. The first tab 706 is configured to move in a range of positions, from a position parallel to the side of the inner sleeve 704 to a position perpendicular to the side of the inner sleeve 704. When the first tab 706 is in a position extending through the first aperture 716 and into the closed outer sleeve compartment 738, the inner sleeve 704 is locked in the outer sleeve 702. When a user presses the first tab 706 to a position parallel to the side of the inner sleeve 704, the user can unlock the packaging apparatus 700 and slide the inner sleeve 704 out of the outer sleeve 702, opening the packaging apparatus 700.

In some implementations of the disclosed technology, there may be multiple locking mechanisms, multiple windows, multiple tabs or other locks, multiple apertures for locking and for unlocking, multiple compartments, multiple materials, and reversible routes of entry of the inner sleeve into the outer sleeve. Some implementations may be configured for one-time use or multiple uses.

Figure 8:
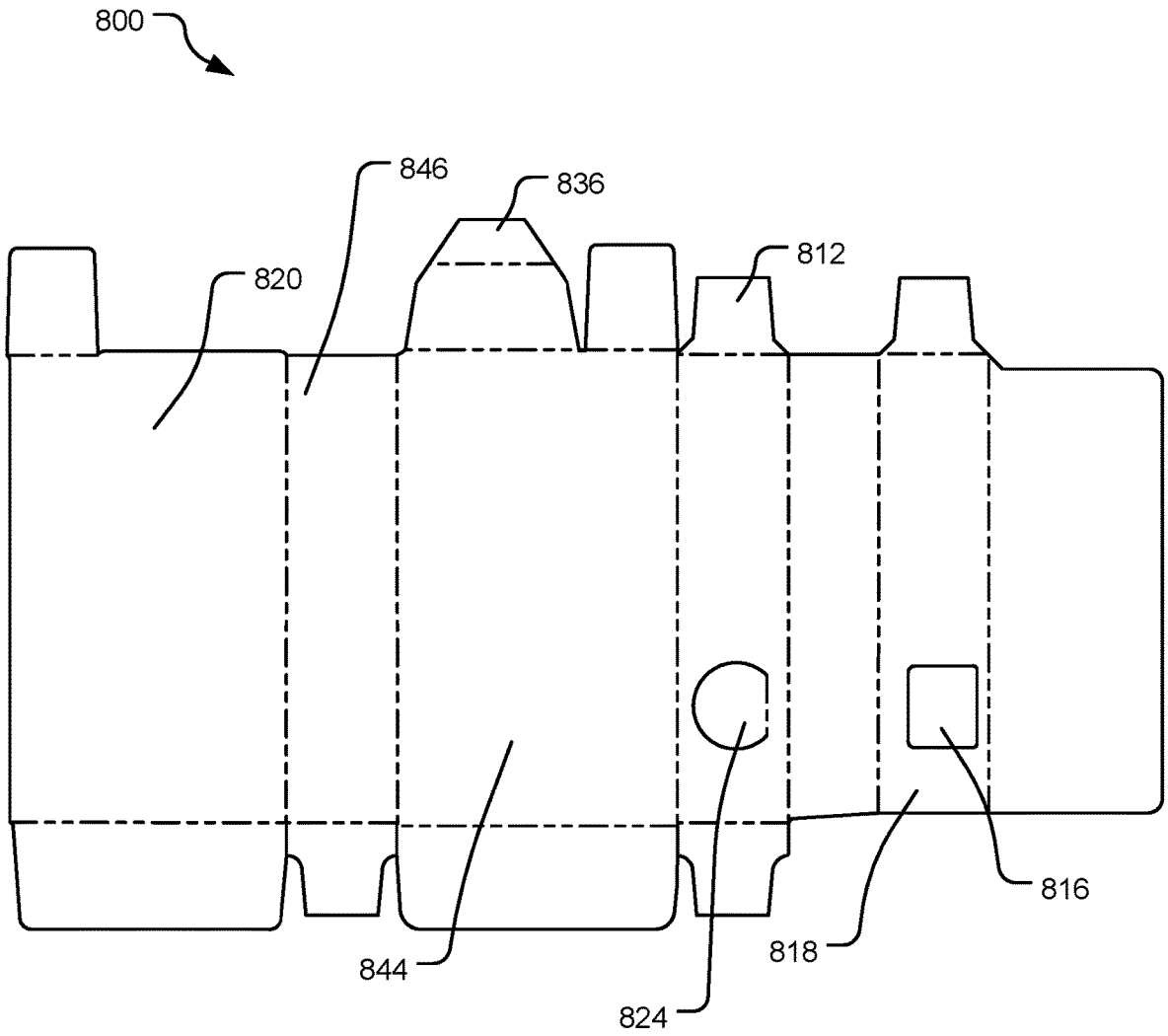
FIG. 8 illustrates a plan view of an example outer sleeve of a packaging apparatus.

FIG. 8 illustrates a side view of an outer sleeve 800 of an unassembled example packaging apparatus. The dashed lines in FIG. 8 depict where the material of the packaging apparatus may be folded when it is assembled. In one implementation, the outer sleeve 800 is shown assembled in FIG. 7A.

The four exterior walls of the outer sleeve 800, a front panel 820, a first side panel 812, a second side panel 846, and a back panel 844 are shown. Inside the outer sleeve 800, an interior compartment may be formed, which includes an interior wall 818, dividing the interior compartment into separate cavities (not shown). A first open outer sleeve compartment may be configured to receive an inner sleeve (not shown), and a second closed outer sleeve compartment may be configured for a locking mechanism.

As shown in FIG. 8, the outer sleeve 800 has a first flap 824 located in the first side panel 812 of the outer sleeve 800. A user's finger, instrument or key (not shown) may depress the first flap 824 into a closed outer sleeve compartment, creating a second aperture (not shown) for access to an interior sliding locking mechanism (discussed in FIG. 7A). A tab on an inner sleeve (not shown) protruding through a first aperture 816 in the outer sleeve 800 into the closed outer sleeve compartment may be depressed or pushed out of the aperture 816 until it is flush or parallel with a side of the inner sleeve to unlock the inner sleeve from the outer sleeve 800, and allow the inner sleeve to slide out of the outer sleeve 800 while the user's finger, an instrument or a key is engaged. Once the inner sleeve slides out of the outer sleeve 800, contents in the inner sleeve are accessible. In some implementations, other apertures may be contemplated for access to the locking mechanism.

In some implementations, a second locking mechanism (described in more detail in FIGS. 11A-F) also locks the inner sleeve in the outer sleeve 800. The second locking mechanism is located between the bottom surface of the inner sleeve and the interior of the outer sleeve 800, and permits the inner sleeve to be removed partially out of the outer sleeve 800 but does not permit the inner sleeve to be removed entirely out of the outer sleeve 800.

One component used in the second locking mechanism is a first flap 836 connected to the outer sleeve 800, shown in FIG. 8. The first flap 836 may be folded down inside the open outer sleeve compartment 800 before the inner sleeve is inserted into the outer sleeve 800. A second flap (not shown) is connected to the inner sleeve and may be folded down under a bottom panel of the inner sleeve before the inner sleeve is inserted into the outer sleeve 800. A third tab (not shown) is located in the bottom surface of the inner sleeve and opens inside the inner sleeve creating an aperture (not shown). After the inner sleeve is fully inserted into the outer sleeve, the inner sleeve may be partially pulled out of the outer sleeve 800, moving the first flap 836 into the aperture in the bottom surface of the inner sleeve and contacting the third tab. When the first flap 836 contacts the third tab, the first flap 836 moves out of the aperture and inner sleeve and back into the outer sleeve 800 and on top of the second flap, facilitating the locking mechanism of a packaging apparatus.

The panels, tabs, flaps, apertures, and other components of the outer sleeve 800 may have different locations in the packaging apparatus than what is shown in FIG. 800. For example, a panel or tab may be moved in a packaging apparatus to accommodate better functioning of one of the disclosed locking mechanisms.

Figure 9:
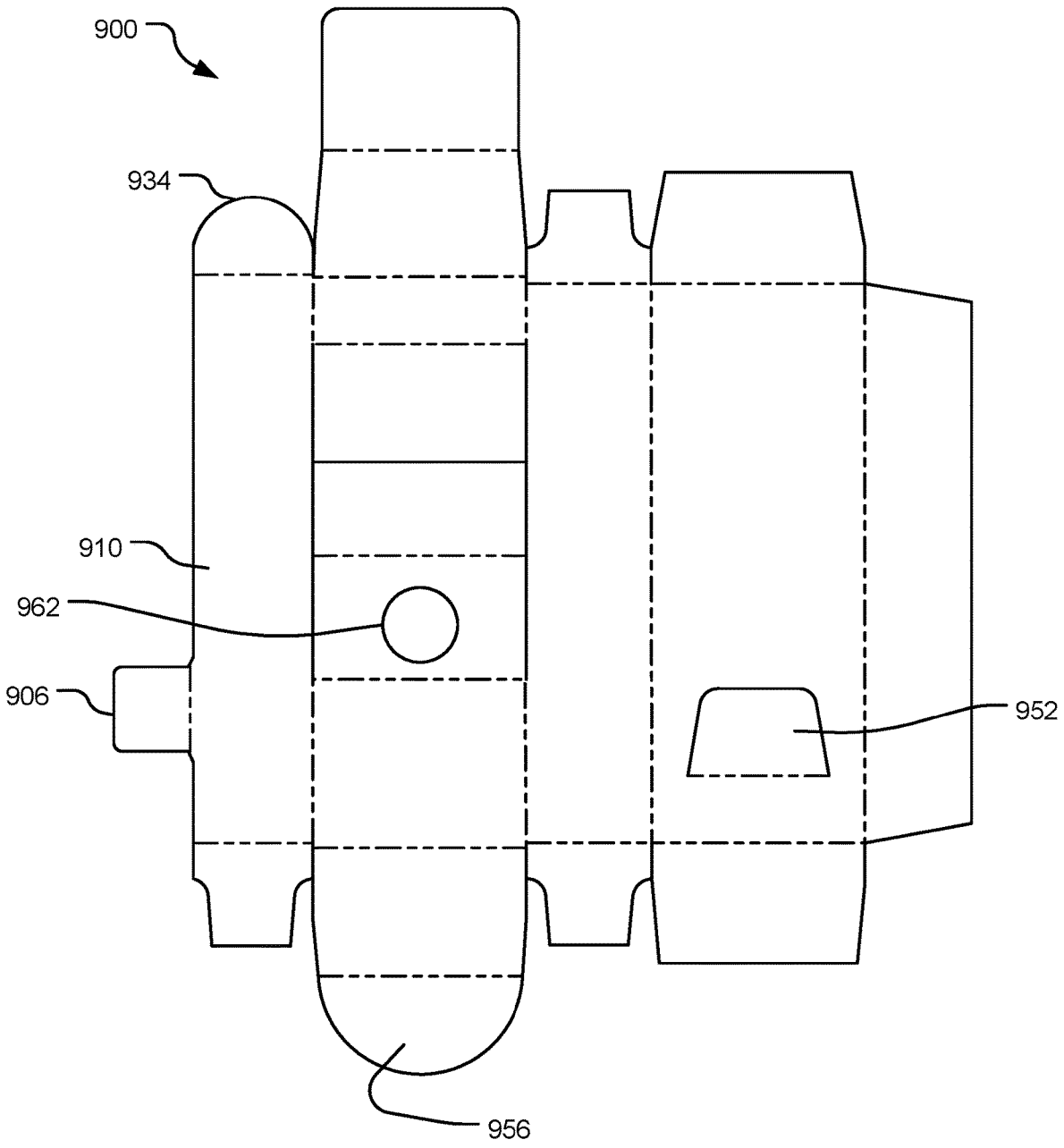
FIG. 9 illustrates a plan view of an example inner sleeve of a packaging apparatus.

FIG. 9 illustrates a side view of an inner sleeve 900 of an unassembled example packaging apparatus. The dashed lines in FIG. 9 depict where the material of the packaging apparatus may be folded when it is assembled. In one implementation, the inner sleeve 900 is shown assembled in FIG. 7A. The walls of the inner sleeve 900 are shown.

An aperture 962 is located in a storage compartment (not shown) formed once the packaging apparatus is assembled. The aperture 962 is used for loading a longer cylindrical or another shaped item into the inner sleeve 900. The item may enter the aperture 962 and extend into the inner sleeve 900 in an outer sleeve compartment (not shown) beyond the inner sleeve storage compartment (not shown). In other implementations, inserts may be used for holding, securing, and storing items in the inner sleeve 900.

A tab 906 is connected to the first side panel 910 of the inner sleeve. Once assembled, in order to insert the inner sleeve 900 into an outer sleeve (not shown) in a packaging apparatus, the tab 906 can be moved or depressed by an instrument or a user's finger toward the first side panel 910 of the inner sleeve 900 until the tab 906 substantially parallel with the first side panel 910 of the inner sleeve 900. Once the tab 906 is substantially parallel with the side 910 of the inner sleeve 900, the inner sleeve 900 may be inserted into the outer sleeve in between two interior walls of the outer sleeve.

The inner sleeve 900 may be inserted into an open outer sleeve compartment until the tab 906 locks into the outer sleeve. The locking mechanism can occur automatically when the tab 906 moves or springs into a first aperture (not shown in FIG. 7A, see first aperture 716 in FIG. 7E) in an interior wall (not shown) of the outer sleeve. The tab 906 may move in a range of positions, for example, from a position substantially parallel to the side of the inner sleeve 900 to a position protruding from the side 910 of the inner sleeve 900, extending through a first aperture (not shown) locking the inner sleeve 900 in place inside the interior wall of the outer sleeve.

A user's finger, instrument or key (not shown) may depress a flap into the outer sleeve, wherein the tab 906 may be depressed or pushed until it is flush or parallel with the side 910 of the inner sleeve 900 to unlock the inner sleeve 900 from the outer sleeve, and allow the inner sleeve 900 to slide out of the outer sleeve while the user's finger, an instrument or a key is engaged. The inner sleeve 900 may be pulled out of the outer sleeve via a pull tab 934.

In some implementations, there may be more than one locking mechanism. A third tab 956 is shown and located on the bottom of the inner sleeve 904. Once the inner sleeve 900 is assembled, the third tab 956 may be folded down under the bottom panel of the inner sleeve 900 before the inner sleeve 900 is inserted into the outer sleeve.

The second flap 952 opens into the inner sleeve 904 creating an aperture (not shown). When the inner sleeve 900 is pulled out of the outer sleeve, a second flap 952 moves into the aperture in the bottom panel of the inner sleeve 900 and contacts the third tab 956. When the second flap 952 contacts the third tab 956, the second flap 952 moves out of the aperture and into the outer sleeve wedging between the second tab and the exterior surface of the bottom panel of the inner sleeve, facilitating another locking mechanism of the packaging apparatus.

The panels, tabs, flaps, apertures, and other components of the outer sleeve may have different locations in the packaging apparatus than what is shown in FIG. 900. For example, a second flap 952 may be moved in the outer sleeve to located between different panels to accommodate better functioning of one of the disclosed locking mechanisms.

FIG. 10A-E illustrates perspective views of example packaging apparatus inserts 1000. An inner sleeve of a packaging apparatus may be configured to receive at least one insert. Each packaging apparatus insert is configured to receive components of any predetermined sizes. The predetermined sizes are based on the intended use of each packaging apparatus and various sizes and configurations are contemplated.

Figure 10A:
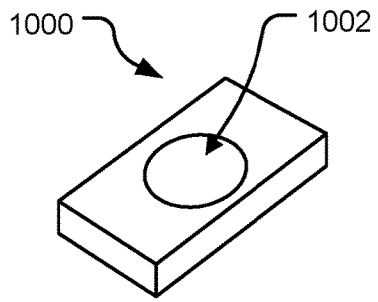
FIG. 10A-E illustrates perspective views of example packaging apparatus inserts.

For example, if a packaging apparatus was intended to hold and store a circular pharmaceutical bottle, the insert 1000 in FIG. 10A is configured to hold and secure a circular bottle. As shown, the insert 1000 in FIG. 10E includes a circular aperture 1002 configured to receive and secure a circular container.

Figure 10B:
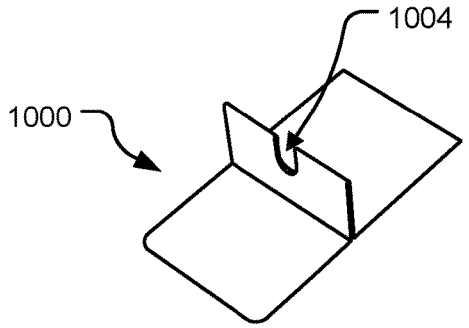

In another example, if a packaging apparatus was intended to hold and store a cylindrical pharmaceutical vial, the insert 1000 in FIG. 10B is configured to hold and secure a cylindrical container. As shown, the insert 1000 in FIG. 10B includes a mouth 1004 configured to receive a cylindrical container.

Figure 10C:
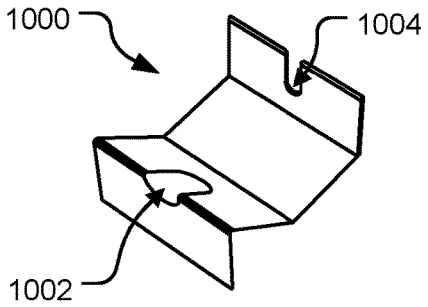
Figure 10D:
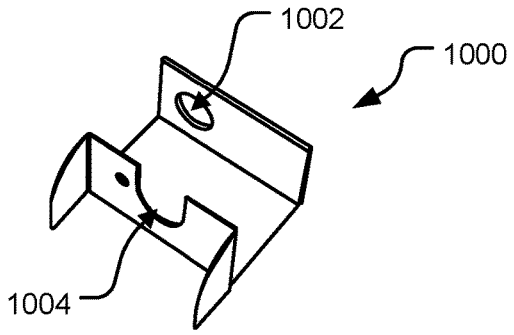
Figure 10E:
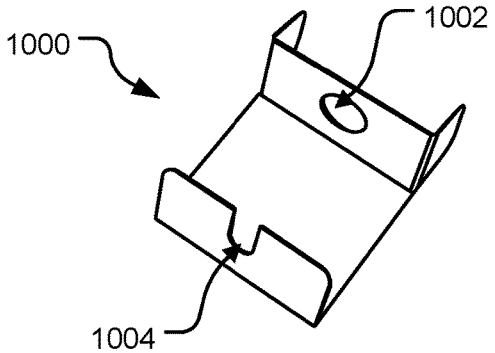

In yet other examples, if a packaging apparatus was intended to hold and store a cylindrical pharmaceutical vial, the insert 1000 in FIGS. 10C-E are configured to hold and secure cylindrical containers. As shown, the inserts 1000 in FIG. 10C-E all include an aperture 1002 to slide a first end of a vial (not shown) into and a mouth 1004 configured to receive the second end of the vial. In other implementations, other apertures, mouths, or other similar receiving and securing items may be included in a packaging apparatus insert depending on the desired use.

FIGS. 11A-F illustrates isometric perspective views of an example packaging apparatus 1100. The packaging apparatus 1100 has an outer sleeve 1102 and an inner sleeve 1104. The packaging apparatus 1100 has one locking mechanism configured to lock the inner sleeve 1104 inside the outer sleeve 1102. In other implementations, there may be more than one locking mechanism. In FIGS. 11A-F, the packaging apparatus 1100 is shown unassembled, assembled, and then partially opened and locked by the locking mechanism.

In the implementation shown in FIG. 11A-F, the locking mechanism is an interior sliding locking mechanism located between the bottom panel of the inner sleeve 1104 and the bottom of the outer sleeve 1102. Once the inner sleeve 1104 has been fully inserted into the outer sleeve 1102, the locking mechanism described in FIGS. 11A-F permits the inner sleeve 1104 to be removed partially out of the outer sleeve 1102 but does not permit the inner sleeve 1104 to be removed entirely out of the outer sleeve 1102.

Figure 11A:
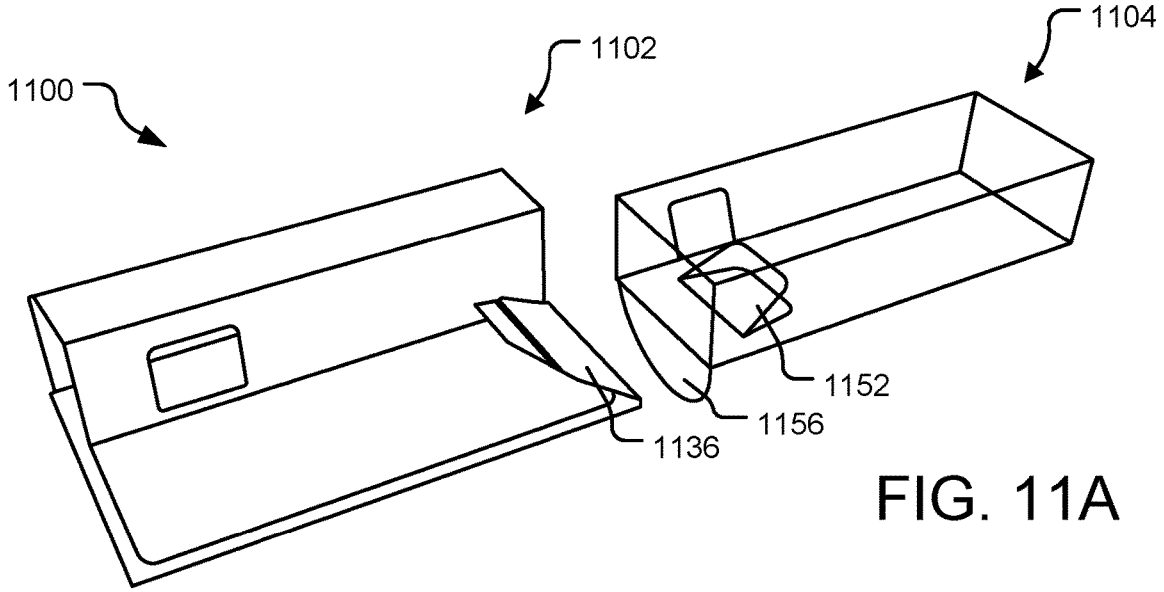
FIG. 11A-F illustrates perspective views of an example packaging apparatus during use.

Referring to FIG. 11A, the packaging apparatus 1100 is shown unassembled. There are three main components utilized in the locking mechanism. Two of the components in the locking mechanism include a first tab 1136 connected to a bottom panel of the outer sleeve 702 and a second tab 1156 connected to a bottom panel of the inner sleeve 1104. Both the first tab 1136 and the second tab 1156 have a range of motion to move approximately 360°. Prior to inserting the inner sleeve 1104 into the outer sleeve 1102, the first tab 1136 is folded into the interior of the outer sleeve 1102 in a position substantially parallel to the interior bottom panel of the outer sleeve 1102 and the second tab 1156 is folded outside and downward to a position substantially parallel to the exterior bottom panel of the inner sleeve 1104. The third component in the locking mechanism is a first flap 1152. The first flap 1152 is configured to move into the interior of the inner sleeve 1104 creating an aperture 1158.

Figure 11B:
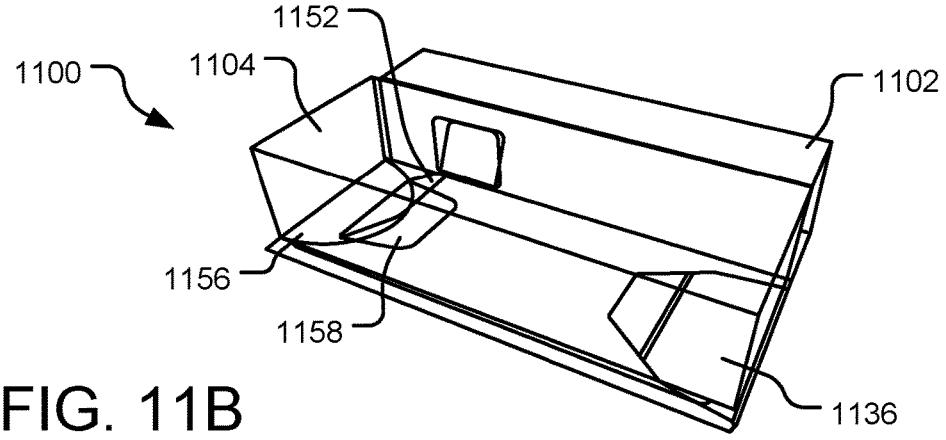

Referring to FIG. 11B, the packaging apparatus 1100 is shown assembled. The inner sleeve 1104 is inserted into the outer sleeve 1102. The alignment of the three main components utilized in the locking mechanism is shown. The first tab 1136, which was folded into the interior of the outer sleeve 1102 in a position substantially parallel to the interior surface of the bottom panel of the outer sleeve 1102 is located between the bottom surface of the bottom panel of the inner sleeve 1104 and the top surface of the bottom panel of the outer sleeve 1102. The second tab 1156, which was folded outside and downward to a position substantially parallel to the exterior surface of the bottom panel of the inner sleeve 1104 is also located between the bottom surface of the bottom panel of the inner sleeve 1104 and the top surface of the bottom panel of the outer sleeve 1102. The first flap 1152 is in a position extending inside the inner sleeve 1104, creating an aperture 1158.

Figure 11C:
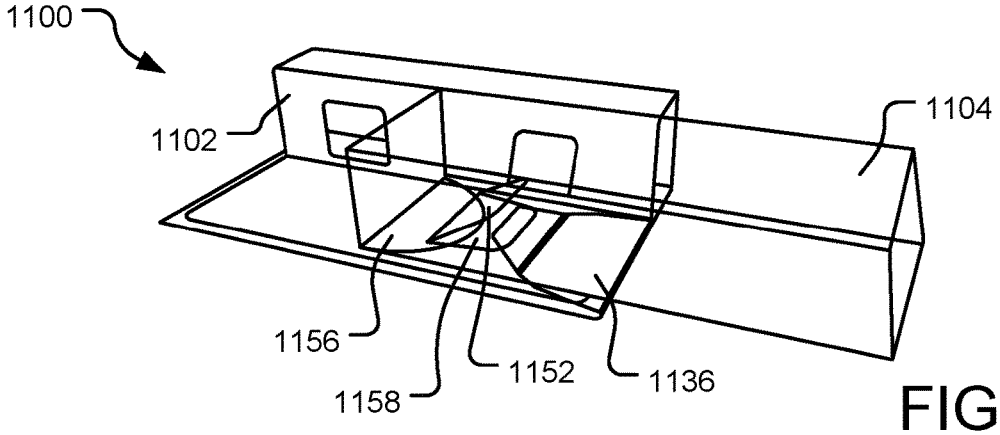

Referring to FIG. 11C, the packaging apparatus 1100 is shown as it is partially opened. When the inner sleeve 1104 is moved partially out of the outer sleeve 1102, the locking mechanism prevents the inner sleeve 1104 from being completely removed from the outer sleeve 1102. As shown in FIG. 11C, as the inner sleeve 1104 slides out of the outer sleeve 1102, the first tab 1136 moves into the aperture 1158 in the bottom panel of the inner sleeve 1104. The second tab 1156 remains positioned substantially parallel to the bottom panel of the inner sleeve 1104.

Figure 11D:
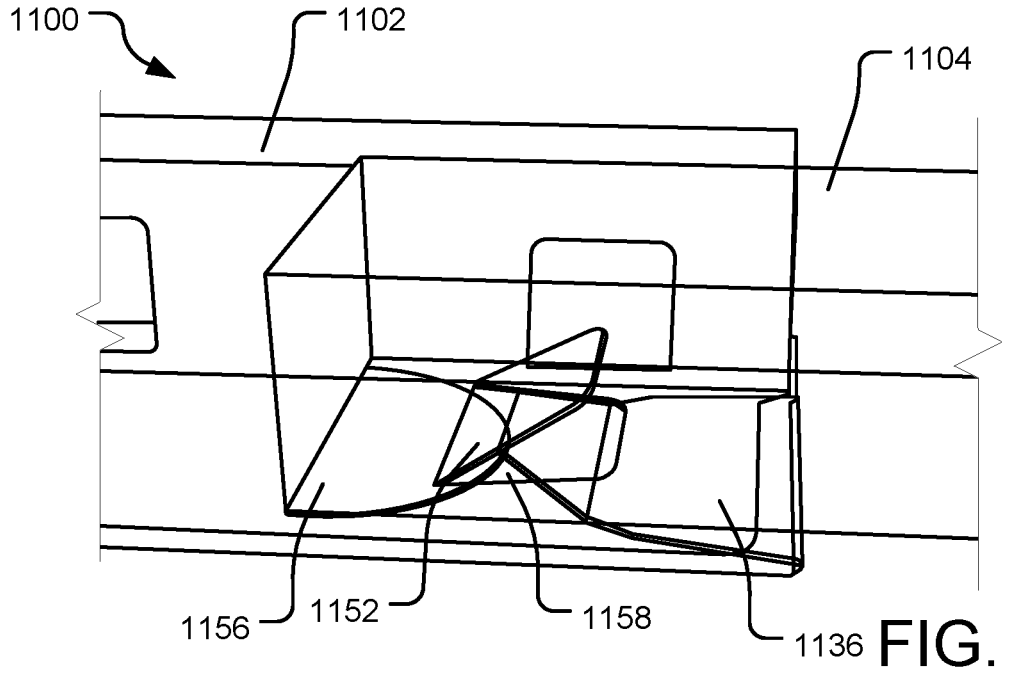

Referring to FIG. 11D, the packaging apparatus 1100 is shown as it is partially opened, and the locking mechanism occurs. As the inner sleeve 1104 is moved partially out of the outer sleeve 1102, the first tab 1136 contacts the first flap 1152. When the first tab 1136 contacts the first flap 1152, the first tab 1136 moves out of the aperture 1158 to the outer sleeve 1102 and locates on top of the second tab 1156.

Figure 11E:
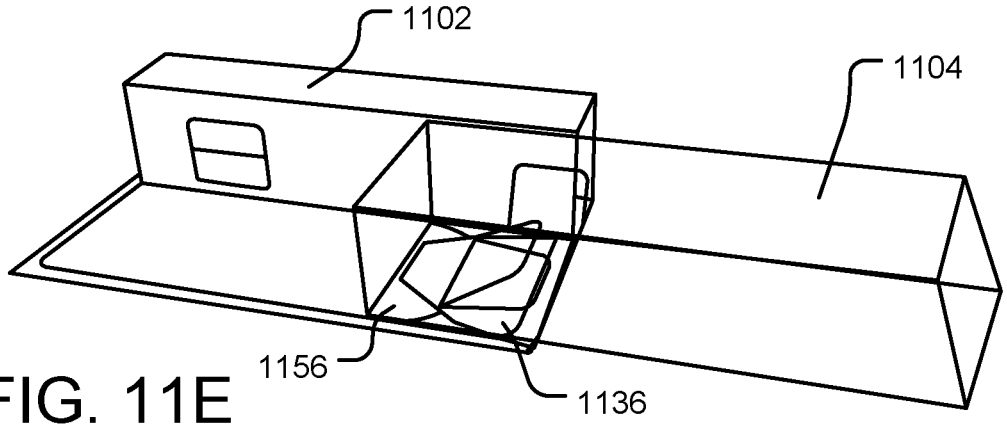

Referring to FIG. 11E, the packaging apparatus 1100 is shown as it is partially opened, and the locking mechanism has occurred. After the first tab 1136 moves out of the aperture 1158 to the outer sleeve 1102 and locates on top of the second tab 1156, the first tab 1136 is trapped between the second tab 1156 and the exterior surface of the bottom panel of the inner sleeve 1104. The locking mechanism prevents the inner sleeve 1104 from being completely removed from the outer sleeve 1102.

Figure 11F:
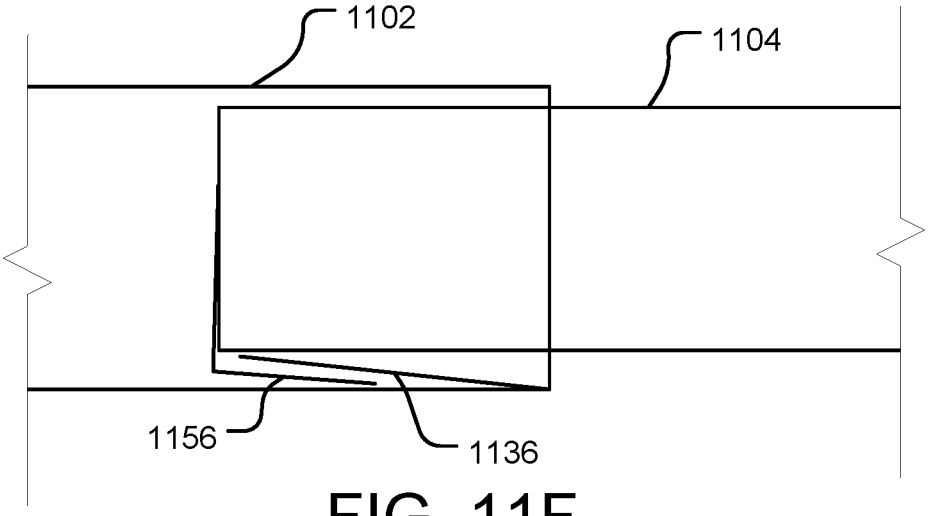

Referring to FIG. 11F, the packaging apparatus 1100 is shown in a schematic diagram as the packaging apparatus 1100 is partially opened, and the locking mechanism has occurred.

FIGS. 12A-I illustrates perspective views of an example of a packaging apparatus 1200. The dashed lines in FIGS. 12A-I depict where the material of the packaging apparatus may be folded when it is assembled. The large arrows between each of FIGS. 12A-I depict an example order of steps of use of the packaging apparatus.

The packaging apparatus 1200 has an outer sleeve 1202, an inner sleeve 1204, and two internal sliding locking mechanisms (described more below in detail) configured to lock the inner sleeve 1204 inside the outer sleeve 1202. In other implementations, there may be one locking mechanism or multiple locking mechanisms. In some implementations, there may be a sequential two or more stage method for the locking mechanisms. In some implementations, the packaging apparatus 1200 may be relockable, resealable, and/or recyclable.

The inner sleeve 1204 is shown with a back panel 1244 of the inner sleeve 1204 facing upward. The outer sleeve 1202 is shown with a front panel 1220 of the outer sleeve 1202 facing upward. The outer sleeve 1202 has a closed outer sleeve compartment 1238. When the packaging apparatus 1200 is assembled in a closed position, the inner sleeve 1204 may be inserted into the outer sleeve 1202 with the inner sleeve 1204 facing either upward or downward and adjacent to the closed outer sleeve compartment 1238.

In the implementations shown in FIGS. 12A-I, the first sliding locking mechanism includes a first tab 1206 located on the inner sleeve 1204. The first tab 1206 may have a springing mechanism where the first tab 1206 extends from the inner sleeve 1204 in a resting condition, and when the first tab 1206 is pushed against a back panel 1244 of the inner sleeve 1204 and released, the first tab 1206 springs back in a preferred direction to a position extending from the inner sleeve 1204.

The inner sleeve 1204 has an inner sleeve storage compartment 1214 on a front panel 1230 (shown in FIG. 12D) for holding or storing items. The inner sleeve storage compartment 1214 can vary in design and shape depending on the design and use of the packaging apparatus 1200, as well as the required design for desired items to be stored in the outer sleeve 1202. For example, the inner sleeve storage compartment 1214 may be designed to securely hold vials, bottles, a vape cartridge, electronic cigarettes, other objects, etc. in place. In some implementations, there may be multiple storage compartments 1214.

Figure 12A:
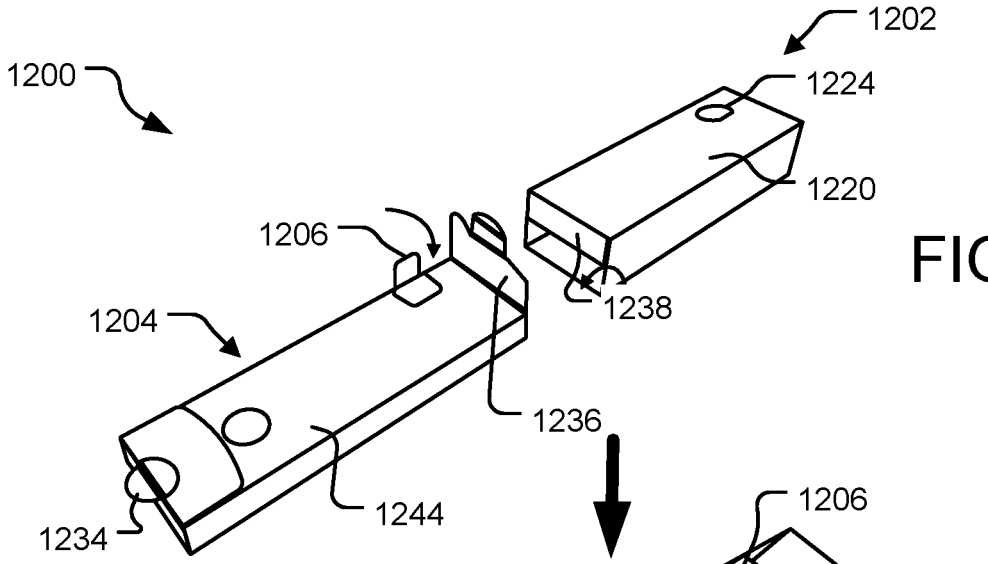
FIG. 12A-I illustrates perspective views of an example packaging apparatus during use.

Before the inner sleeve 1204 is inserted into the outer sleeve 1202 for locking, the first tab 1206 protrudes from an edge on the back panel 1244 of the inner sleeve 1204, as shown in FIG. 12A. In order to insert the inner sleeve 1204 into the outer sleeve 1202, the first tab 1206 can be moved or depressed by an instrument or a user's finger toward the back panel 1244 of the inner sleeve 1204 until the first tab 1206 is substantially parallel or flush with the back panel 1244 of the inner sleeve 1204.

Once the first tab 1206 is substantially parallel or flush with the back panel 1244 of the inner sleeve 1204, the inner sleeve 1204 may be inserted into the outer sleeve 1202 in between two interior walls of the outer sleeve 1202, adjacent to a side wall 1218 of the closed outer sleeve compartment 1238.

The first locking mechanism can occur automatically when the first tab 1206 moves or springs into a first aperture (not shown) in the side wall 1218 of the closed outer sleeve compartment 1238 of the outer sleeve 1202, and the first tab 1206 moves from a position parallel to the back panel 1244 of the inner sleeve 1204 to a position approximately perpendicular to the back panel 1244 of the inner sleeve 1204, locking the inner sleeve 1204 in place inside the side wall 1218 of the closed outer sleeve compartment 1238 of the outer sleeve 1202. In some implementations, the locking mechanism may not occur automatically and may require manual assistance.

In FIG. 12A, a first flap 1224 is located in the front panel 1220 of the outer sleeve 1202. A user's finger, an instrument or key may press the first flap 1224 through a second aperture (shown as second aperture 1222 in FIG. 12H) for access to a closed outer sleeve compartment 1238. In the closed outer sleeve compartment 1238, a user may depress or push down on a first tab 1206 until it is flush or parallel with a back panel 1244 of the inner sleeve 1204 to unlock the inner sleeve 1204 from the outer sleeve 1202, and allow the inner sleeve 1204 to slide out of the outer sleeve 1202 while the finger, instrument, or key is engaged. Once the inner sleeve 1204 is removed from the outer sleeve 1202, contents in the inner sleeve 1204 are accessible. In some implementations, other apertures may be contemplated for access to the locking mechanism.

In some implementations, as shown in FIGS. 12A-I, the inner sleeve 1204 may have a pull tab 1234 for easier insertion and removal of the inner sleeve 1204 into and from the outer sleeve 1202. In some implementations, the pull tab 1234 is designed to tear off if the carton is locked. For example, the pull tab 1234 may include a perforated section allowing the pull tab 1234 to tear off if the packaging apparatus is used improperly (e.g., by a child trying to pull on a pull tab with their fingers in an adverse direction or use their teeth to open it). In some implementations, the perforated section may leave enough material for an adult to use the packaging apparatus but prevent a child from use.

The second sliding locking mechanism includes a second tab 1236 located on the back panel 1244 of the inner sleeve 1204, which can be moved or depressed by an instrument or a user's finger toward the back panel 1244 of the inner sleeve 1204 until the second tab 1236 is substantially parallel or flush with the back panel 1244 of the inner sleeve 1204. The second tab 1236 must be located under the first tab 1206 (in between the first tab 1206 and the back panel 1244 of the inner sleeve 1204) for both locking mechanisms to occur.

The second tab 1236 may vary in shapes and sizes. In some implementations, the second tab 1236 may have multiple joints, as shown in FIG. 12A and in FIG. 15. In some implementations, the second tab 1236 can vary in shapes. Further, an end joint of the second tab 1236 may be bent to facilitate better locking in the second locking mechanism as the second tab rides into an aperture of the outer sleeve. The joints, shapes, and functions of the second tab 1236 may be tailored to each packaging apparatus.

Once the first tab 1206 is substantially parallel or flush with the back panel 1244 of the inner sleeve 1204, the inner sleeve 1204 may be inserted into the outer sleeve 1202 in between two interior walls of the outer sleeve 1202, adjacent to a side wall 1218 of the closed outer sleeve compartment 1238.

The second locking mechanism can occur automatically when the inner sleeve 1204 is removed from the outer sleeve 1202. As the inner sleeve 1204 is pulled from the outer sleeve 1202, for example, via a pull tab 1234, the second tab 1236 enters a third aperture located in the side wall 1218 of the closed outer sleeve compartment 1238. The jointed shape of the second tab 1236 allows the second tab 1236 to ride into the third aperture. In some implementations, the second locking mechanism can lock the inner sleeve 1204 in the outer sleeve 1202 permanently. In some implementations, the second locking mechanism can robustly lock the inner sleeve 1204 in the outer sleeve 1202. The second locking mechanism can lock the inner sleeve 1204 in the outer sleeve 1202 with varying or no access to the inner sleeve storage compartment 1214. The second locking mechanism keeps the inner sleeve 1204 and the outer sleeve 1202 together, making it easier for a user to reseal and reuse the locking package 1200. The disclosed design prevents user error in resealing, reusing, and relocking the packaging apparatus 1200.

Figure 12B:
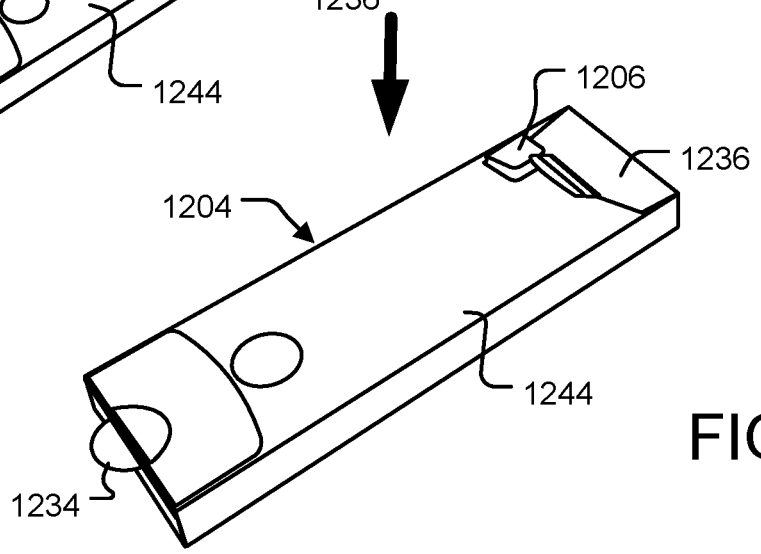
Figure 12C:
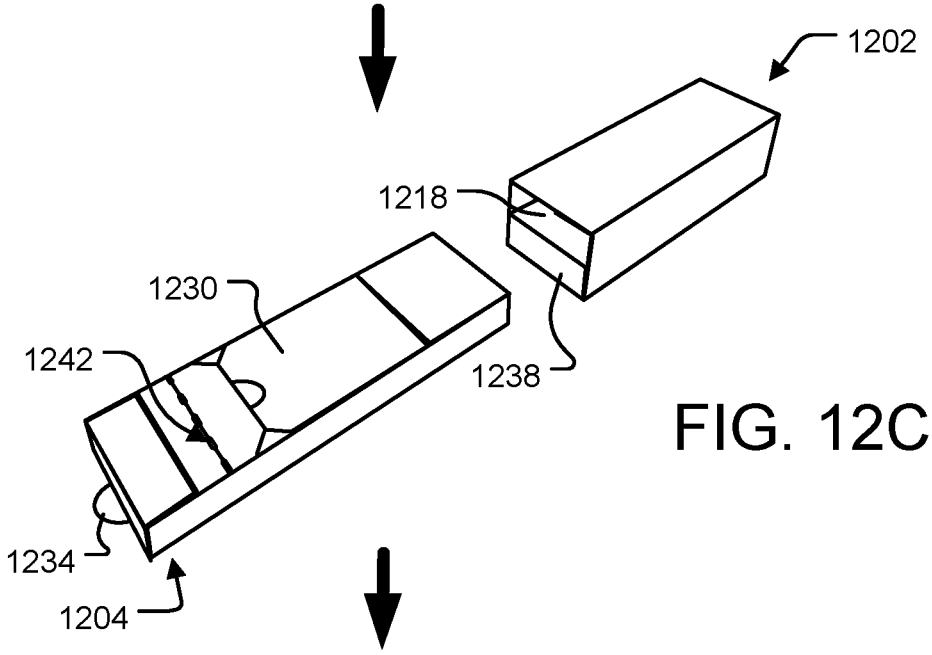

In FIG. 12B, the inner sleeve 1204 is shown with the second tab 1236 located substantially parallel or flush with the back panel 1244 of the inner sleeve 1204 and located under the first tab 1206 (in between the first tab 1206 and the back panel 1244 of the inner sleeve 1204).

In FIGS. 12B-F, the inner sleeve 1204 and the outer sleeve 1202 are rotated 180°. A view of a front panel 1230 of the inner sleeve 1204 and a back panel 1244 of the outer sleeve 1202 facing upward in FIGS. 12C and D. The inner sleeve 1204 in FIGS. 12C and D is shown with a folding lid 1242. In one implementation, items may be placed in the inner sleeve storage compartment 1214 and the folding lid 1242 may be extended to meet the front panel 1230 to close the inner sleeve storage compartment 1214, securing the items inside the inner sleeve 1204.

Figure 12D:
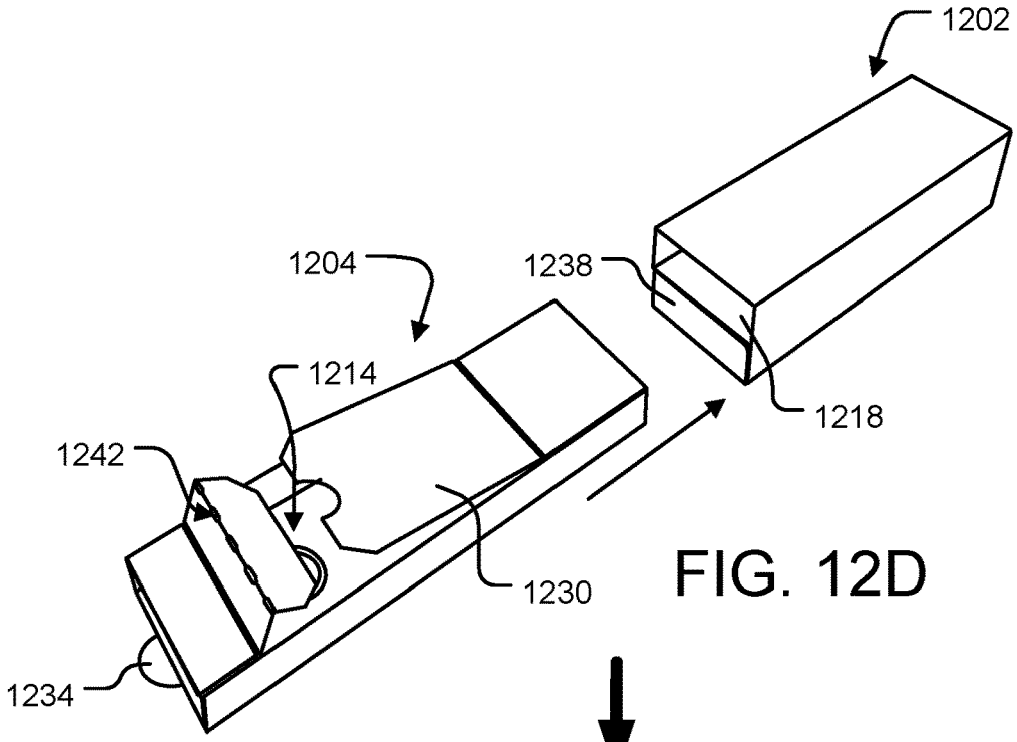
Figure 12E:
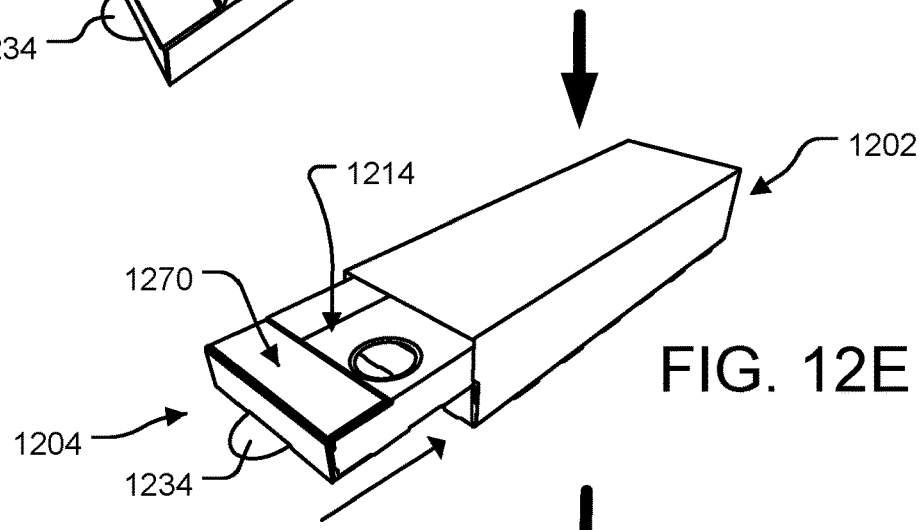

In another implementation, as shown in FIGS. 12D and 12E, the folding lid 1242 may be folded so that the folding lid bends down and under forming a durable inner sleeve end compartment 1270 within the inner sleeve storage compartment 1214, shortening the length of the inner sleeve storage compartment 1214. The inner sleeve durable end compartment 1270 may have rectangular strength of four vertical walls and decreases the risk of a child from trying to access the contents inside the inner sleeve storage compartment 1214 because it is more difficult to break into or tamper with the end of the inner sleeve 1204. For example, it may be impossible to slip a finger into the inner sleeve storage compartment 1214 when there is a durable inner sleeve end compartment 1270 on the end.

As shown in FIGS. 12D and 12E, the inner sleeve 1204 may then be inserted into the outer sleeve 1202 in the direction of the arrow adjacent to the side wall 1218 of the closed outer sleeve compartment 1238, securing the items in the inner sleeve 1204 and locking the inner sleeve in the outer sleeve 1202.

In FIG. 12D, the front panel 1230 of the inner sleeve 1204 may be inserted into the outer sleeve 1202 facing upward. In some implementations, the inner sleeve 1204 may be inserted into the outer sleeve 1202 with the front panel 1230 facing downward. However, in order for the two locking mechanisms to lock the inner sleeve 1204 in the outer sleeve 1202, the back panel 1244 must be inserted adjacent to the side wall 1218 of the closed outer sleeve compartment 1238. In other words, the first tab 1206 must enter the first aperture (not shown) and the second tab 1236 muster enter the third aperture (not shown) located on the side wall 1218 of the closed outer sleeve compartment 1238 for the locking mechanisms to occur.

Figure 12F:
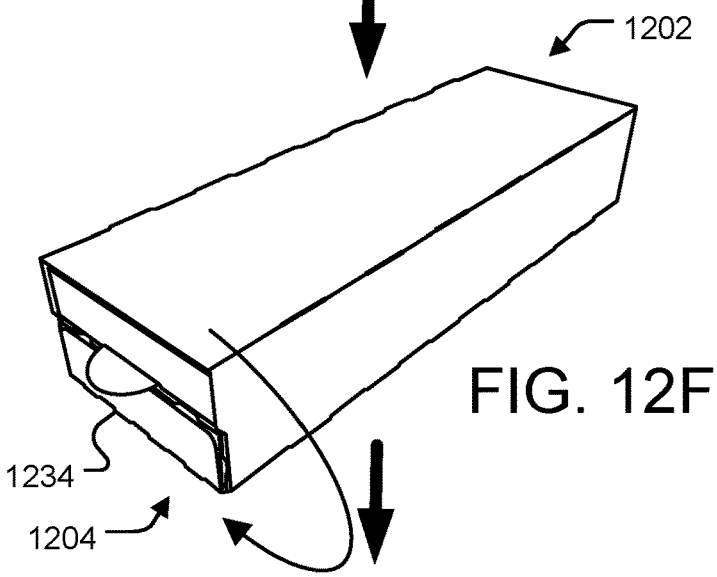

FIG. 12E shows the inner sleeve 1204 partially inserted into the outer sleeve 1202 and FIG. 12F shows the inner sleeve 1204 fully inserted into the outer sleeve 1202. The inner sleeve 1204 is located adjacent to and flush to the closed outer sleeve compartment 1238. The packaging apparatus 1200 may be rotated 180° degrees, as depicted by the smaller arrow, and shown in FIG. 12G.

Figure 12G:
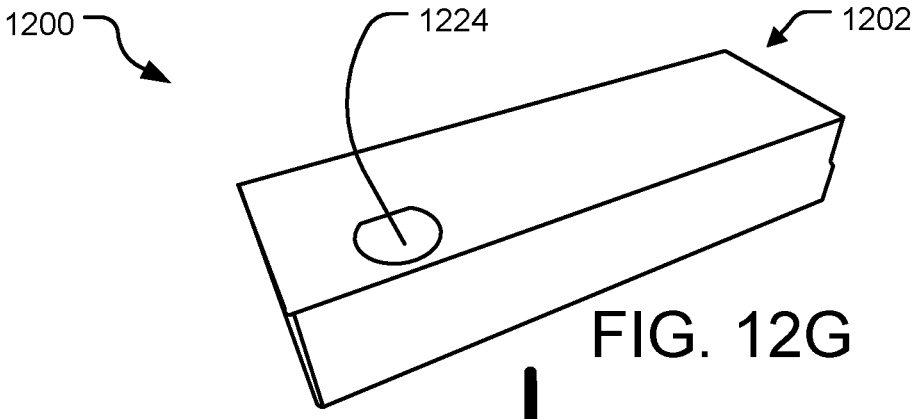

FIG. 12G shows the inner sleeve 1204 fully inserted into the outer sleeve 1202, and the packaging apparatus 1200 rotated 180° degrees from the position in FIG. 12F with the front panel 1220 of the outer sleeve 1202 facing upward. A first flap 1224 is shown, which can be depressed into the outer sleeve 1202 for access to the interior of the closed outer sleeve compartment 1238. The first flap 1224 provides another sophisticated step for a user to take in order to unlock a child-resistant storage container.

Figure 12H:
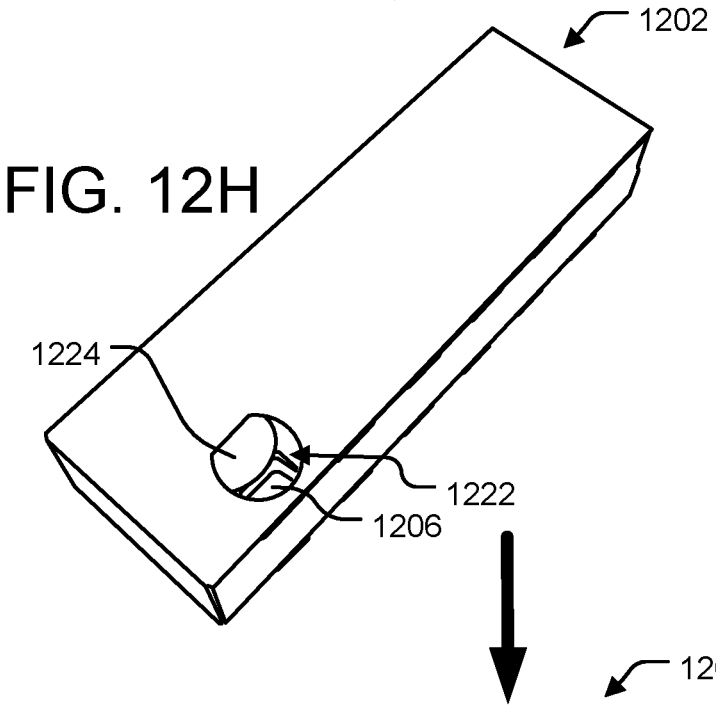

FIG. 12H shows the first flap 1224 being depressed into the outer sleeve 1202 into a second aperture 1222 on the front panel 1220 for access to the interior of the closed outer sleeve compartment 1238 and the first tab 1206 located on the inner sleeve 1204.

Figure 12I:
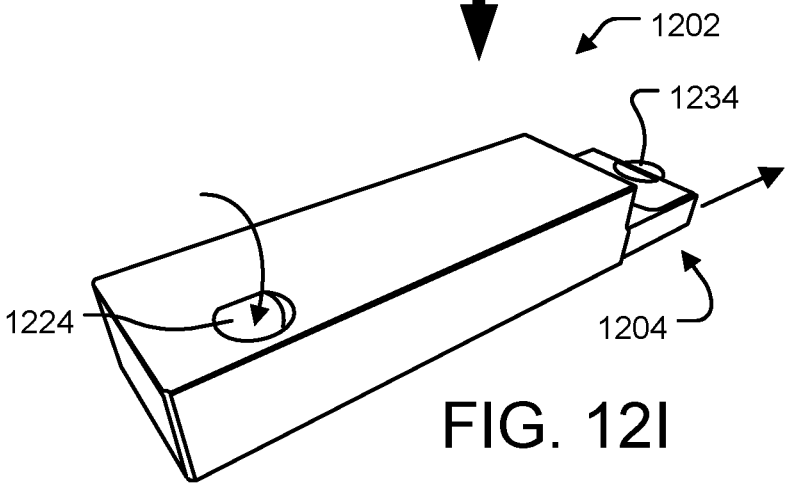

FIG. 12I shows the first flap 1224 being depressed into the outer sleeve 1202 into the second aperture 1222 on the front panel 1220 in a direction depicted by a first arrow for access to the interior of the closed outer sleeve compartment 1238 and the first tab 1206 located on the inner sleeve 1204, and a user pressing the first tab 1206 to a position approximately parallel to the back panel 1244 of the inner sleeve 1204 (not shown), unlocking the packaging apparatus 1200 and sliding the inner sleeve 1204 partially out of the outer sleeve 1202 via the pull tab 1234, as depicted by a second arrow.

FIGS. 13A-D illustrates perspective views of an example of an inner sleeve 1300 of a packaging apparatus. The dashed lines in FIGS. 13A-D depict where the material of the packaging apparatus may be folded when it is assembled.

Figures 13A, 13B, 13C, 13D:
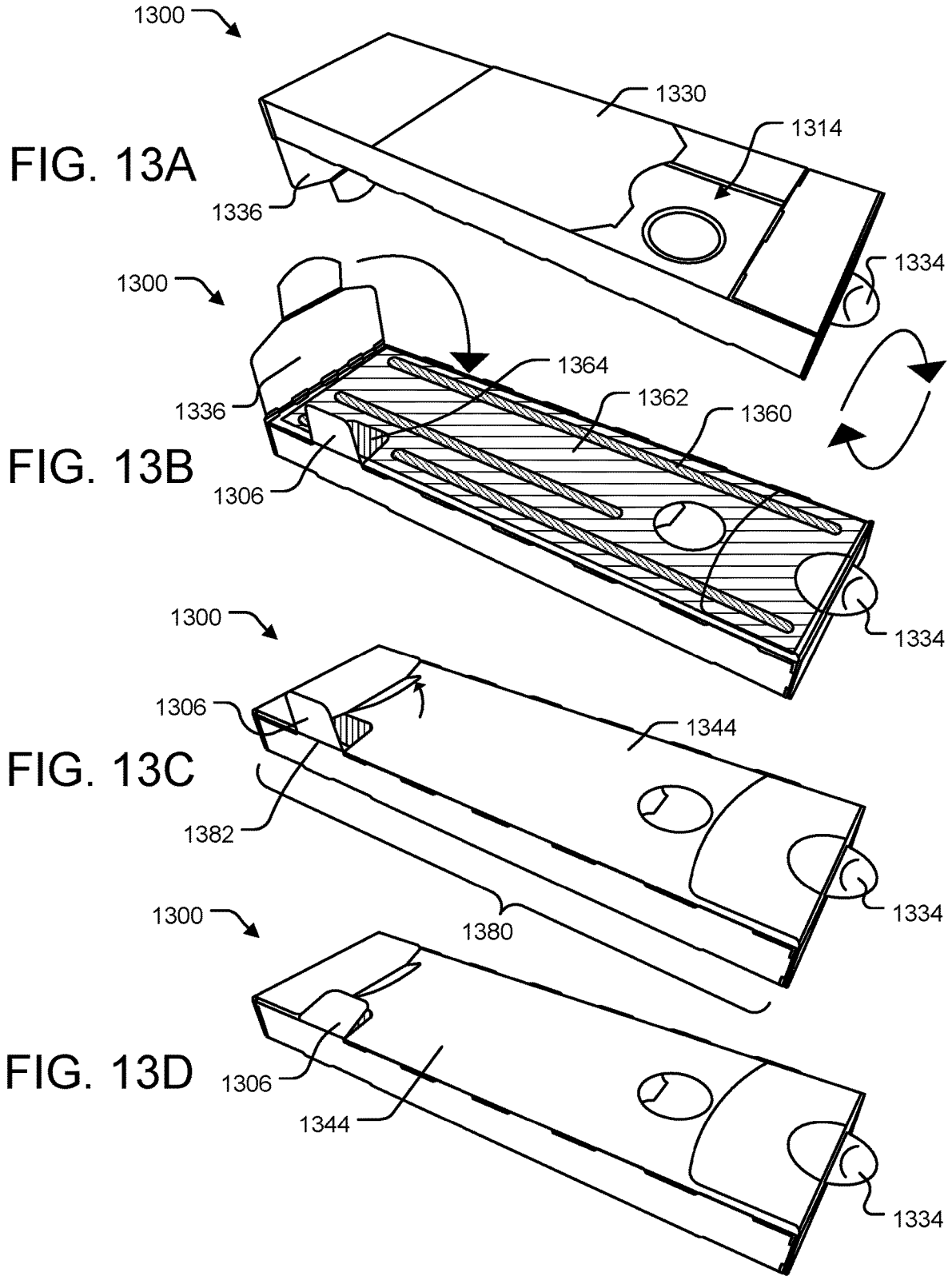
FIG. 13A-D illustrates perspective views of an example packaging apparatus during use.

The inner sleeve 1300 is shown with a front panel 1330 of the inner sleeve 1300 facing upward in FIG. 13A. The inner sleeve 1300 has an inner sleeve storage compartment 1314 on the front panel 1330 for holding or storing items. The inner sleeve storage compartment 1314 can vary in design and shape depending on the design and use of the packaging apparatus. For example, the inner sleeve storage compartment 1314 may be designed to securely hold vials, bottles, a vape cartridge, electronic cigarettes, other objects, etc. in place. In some implementations, there may be multiple storage compartments 1314.

In some implementations, as shown in FIGS. 13A-D, the inner sleeve 1300 may have a pull tab 1334 for easier insertion and removal of the inner sleeve 1300 into and from an outer sleeve (not shown) of a packaging apparatus. In some implementations, the pull tab 1334 is designed to tear off if the carton is locked. For example, the pull tab 1334 may include a perforated section allowing the pull tab 1334 to tear off if the packaging apparatus is used improperly (e.g., by a child trying to pull on a pull tab with their fingers in an adverse direction or use their teeth to open it). In some implementations, the perforated section may leave enough material for an adult to use the packaging apparatus but prevent a child from use.

In FIG. 13B, the inner sleeve 1300 is rotated 180° (as depicted by the arrows) and shown with a cross-sectional view of an inner layer of the inner sleeve 1300 under the back panel 1344 facing upward. The first sliding locking mechanism (described in detail in FIG. 12A-I) includes a first tab 1306 located on the inner sleeve 1300. The first tab 1306 extends from the inner sleeve 1300 in a resting condition, and when the first tab 1306 is pushed against the back panel 1344 and released, the first tab 1306 springs back in a preferred direction to a position extending from the inner sleeve 1300 due to memory properties. For example, the memory properties of the first tab 1306 may be attributed to the laminated material in the inner sleeve 1300 and the overlay of the first tab 1306 on top of the second tab 1336.

In some implementations, the first tab 1306 may bend into and out of a locking position with a grain direction of the paperboard in the first tab 1306. For example, the first tab 1306 bends and returns to a locked position with the grain direction of the paperboard, the grain direction being orthogonal to the fold line 1382 of the first tab 1306, and the fold line 1382 being parallel and aligned to the length 1380 of the inner sleeve.

In some implementations, an extra panel (e.g., a glue lap layer 1362) may be located under the back panel 1344 (not shown in FIG. 13B) and inside the inner sleeve 1300. The glue lap layer 1362 may be used to secure the inner sleeve 1300 during assembly and add another durable component to the packaging apparatus. The glue lap layer 1362 may be affixed to the back panel 1344 in a variety of ways. For example, the glue lap layer 1362 may be glued to the back panel 1344 via strips of glue (e.g., see glue pattern 1360). The majority of the glue lap layer 1362 is not visible to a user with the exception of a visible glue lap area 1364. The visible glue lap area 1364 prevents the first tab 1306 from being pressed by a user into the inside of the inner sleeve 1300.

An arrow in FIG. 13B depicts that the second tab 1336 may be folded down toward the inner sleeve. Similarly, as shown in FIG. 13D, the first tab 1306 may be folded down toward the inner sleeve on top of the second tab 1336.

The second sliding locking mechanism includes a second tab 1336 located on the back panel 1344 of the inner sleeve 1300, which can be moved or depressed by an instrument or a user's finger toward the back panel 1344 of the inner sleeve 1300 until the second tab 1336 is substantially parallel or flush with the back panel 1344 of the inner sleeve 1300 (see FIG. 13D). The second tab 1336 must be located under the first tab 1306 (in between the first tab 1306 and the back panel 1344 of the inner sleeve 1300) for both locking mechanisms to occur.

As shown in FIGS. 13A-D, the second tab 1336 may have at least two joints, and joints of different shape for multiple reasons. The design of the second tab 1336 provides memory properties to the second tab 1336, provides memory properties to the first tab 1306 during overlay of the first tab 1306 on top of the second tab 1336, determines how far the inner sleeve 1300 can extend out of the outer sleeve when the second locking mechanism is occurring, and blocks the first tab 1306 from being pushed into the inner sleeve 1300.

Figure 15A:
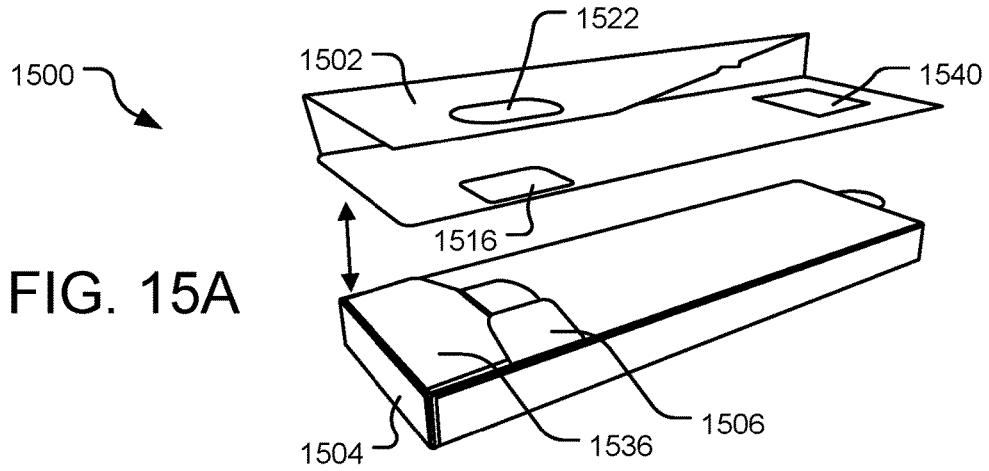
FIG. 15A-E illustrates cross-sectional perspective views of an example packaging apparatus during use.
Figure 15B:
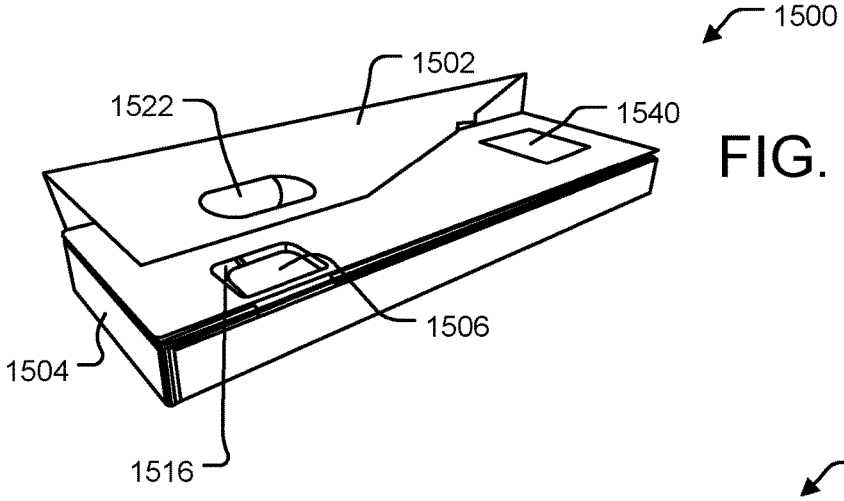
Figure 15C:
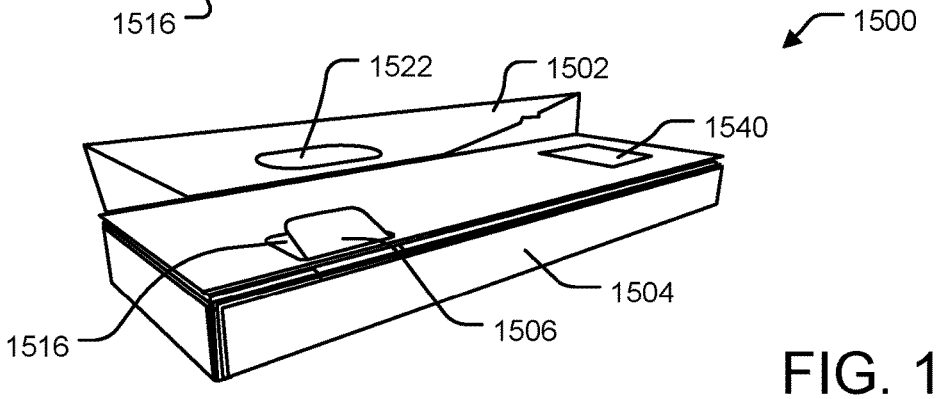
Figure 15D:
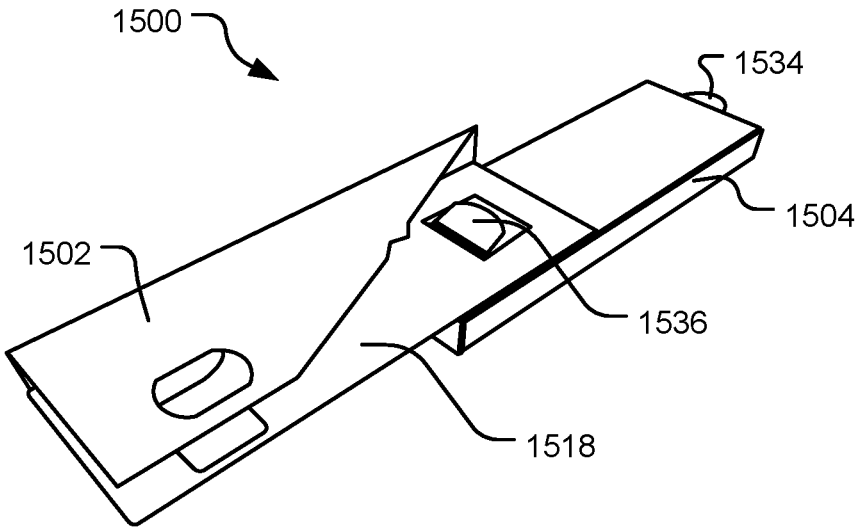

As described in more detail in FIGS. 15D and E, the second locking mechanism may permanently lock the inner sleeve 1300 and the outer sleeve together, making it more difficult for a user to disassemble the packaging apparatus and easier for a user to reuse and reseal the packaging apparatus. In some implementations, the second locking mechanism may robustly lock the inner sleeve in the outer sleeve.

Figure 14A:
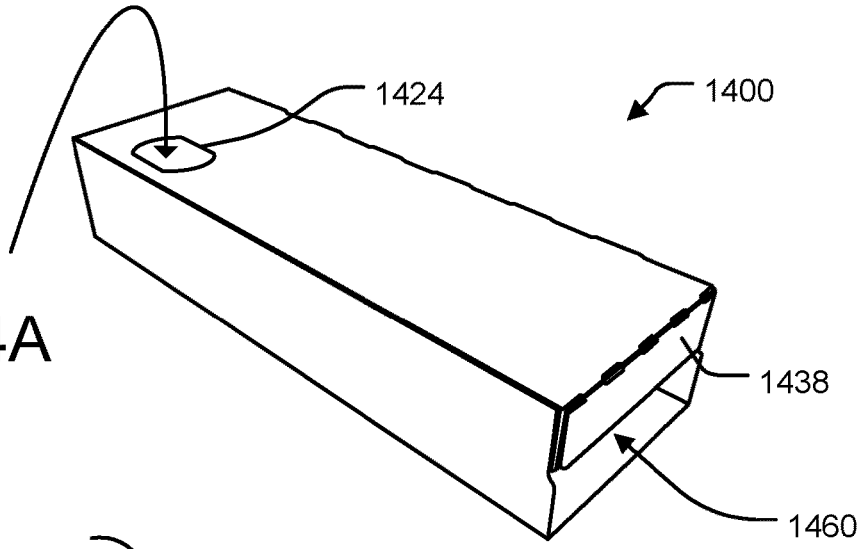
FIG. 14A-C illustrates perspective views of an example packaging apparatus during use.
Figure 14B:
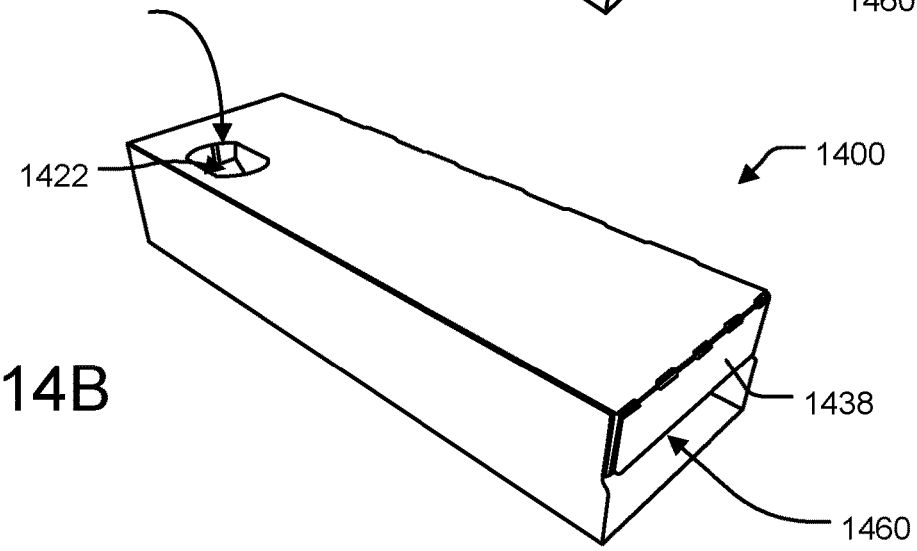
Figure 14C:
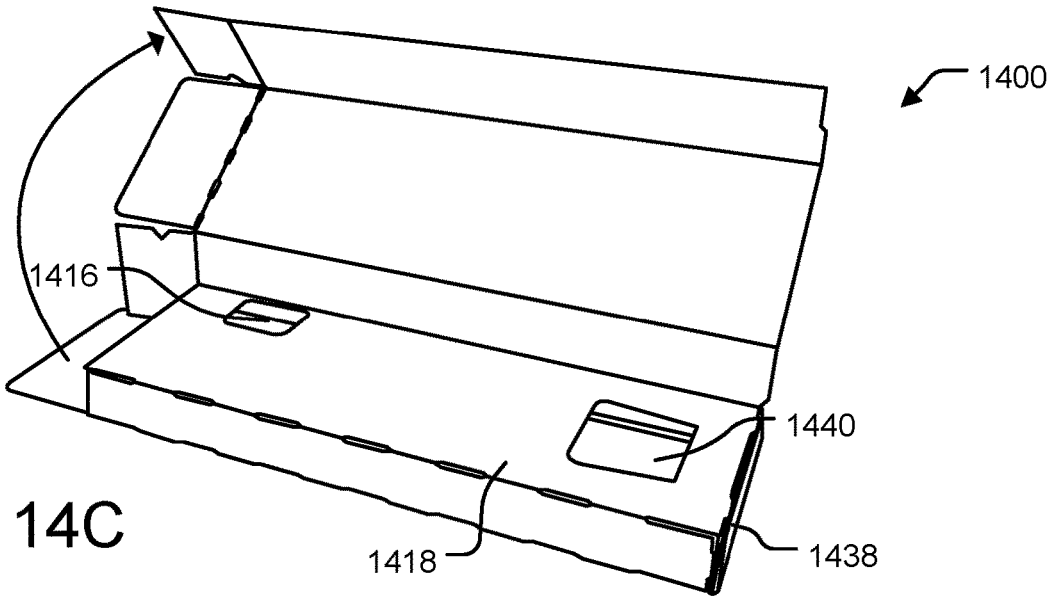

FIG. 14A-C illustrates perspective views of an example of an outer sleeve 1400 of a packaging apparatus. In FIGS. 14A and 14B, an arrow depicts that a first flap 1424 can be depressed into an aperture (not shown) for access into the closed outer sleeve compartment 1438. FIG. 14B shows the first flap 1424 being depressed into a second aperture 1422 for access into the closed outer sleeve compartment 1438. An open outer sleeve compartment 1460 is also shown where an inner sleeve may be inserted into the outer sleeve 1400.

FIG. 14C shows the outer sleeve 1400 partially disassembled, as depicted by an arrow opening the outer sleeve 1400. A first aperture 1416 is shown. When the first locking mechanism (described in FIGS. 12A-I) occurs, a tab on an inner sleeve (not shown) can enter the first aperture 1416, thereby locking the inner sleeve inside the outer sleeve. When the second locking mechanism (described in FIGS. 12A-I) occurs, a second tab on an inner sleeve (not shown) can enter the third aperture 1440 in a side wall 1418 of the outer sleeve 1400, thereby locking the inner sleeve inside the outer sleeve 1400. In some implementations, the locking mechanisms lock the inner sleeve into the outer sleeve 1400 whereby the packaging apparatus is partially or fully closed.

FIG. 15A-E illustrates cross-sectional partial perspective views of an example packaging apparatus 1500 during use. FIG. 15A shows cross-sectional partial perspective views of the outer sleeve 1502 and the inner sleeve 1504 in the packaging apparatus 1500 before assembly. The outer sleeve 1502 shown in FIGS. 15A-E includes three apertures for use with two locking mechanisms: a first aperture 1516, a second aperture 1522, and a third aperture 1540. The inner sleeve 1504 shown includes a first tab 1506 positioned over a second tab 1536. The first tab 1506 is used in the first locking mechanism and the second tab 1536 is used in the second locking mechanism.

FIG. 15B shows a cross-sectional partial perspective view of the outer sleeve 1502 encompassing the inner sleeve 1504. The packaging apparatus 1500 is in an unlocked position, showing a first tab 1506 of the inner sleeve 1504 substantially parallel to the inner sleeve 1504 and adjacent to the first aperture 1516 of the outer sleeve 1502.

FIG. 15C shows a cross-sectional partial perspective view of the outer sleeve 1502 encompassing the inner sleeve 1504. The packaging apparatus 1500 is in a locked position by the first locking mechanism, showing the first tab 1506 of the inner sleeve 1504 protruding through the first aperture 1516 of the outer sleeve 1502. The second aperture 1522 of the outer sleeve 1502, where a user inserts an instrument or finger to access the locking mechanism, is shown. The third aperture 1540 of the outer sleeve 1502 for the second locking mechanism is also shown.

FIG. 15D shows a cross-sectional partial perspective view of the outer sleeve 1502 partially encompassing the inner sleeve 1504. The packaging apparatus 1500 is in an unlocked position, showing the second tab 1536 of the inner sleeve 1504 beginning to protrude through a third aperture 1540 of the outer sleeve 1502. For example, when a user pulls the inner sleeve 1504 out of the outer sleeve 1502 via the pull tab 1534, the second tab 1536 of the inner sleeve 1504 springs from a position substantially parallel to the inner sleeve 1504 to a position extending through the third aperture 1540 in the side wall 1518 of the outer sleeve 1502.

Figure 15E:
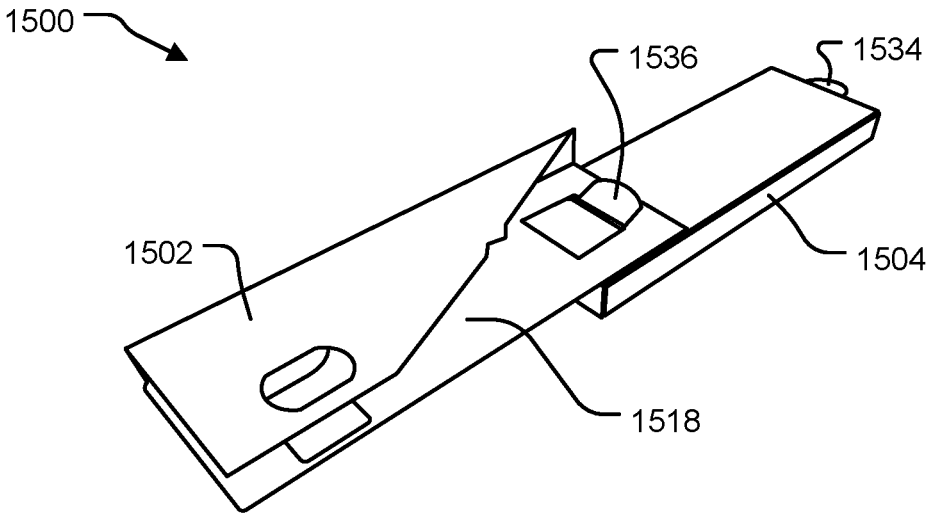
Figure 16:
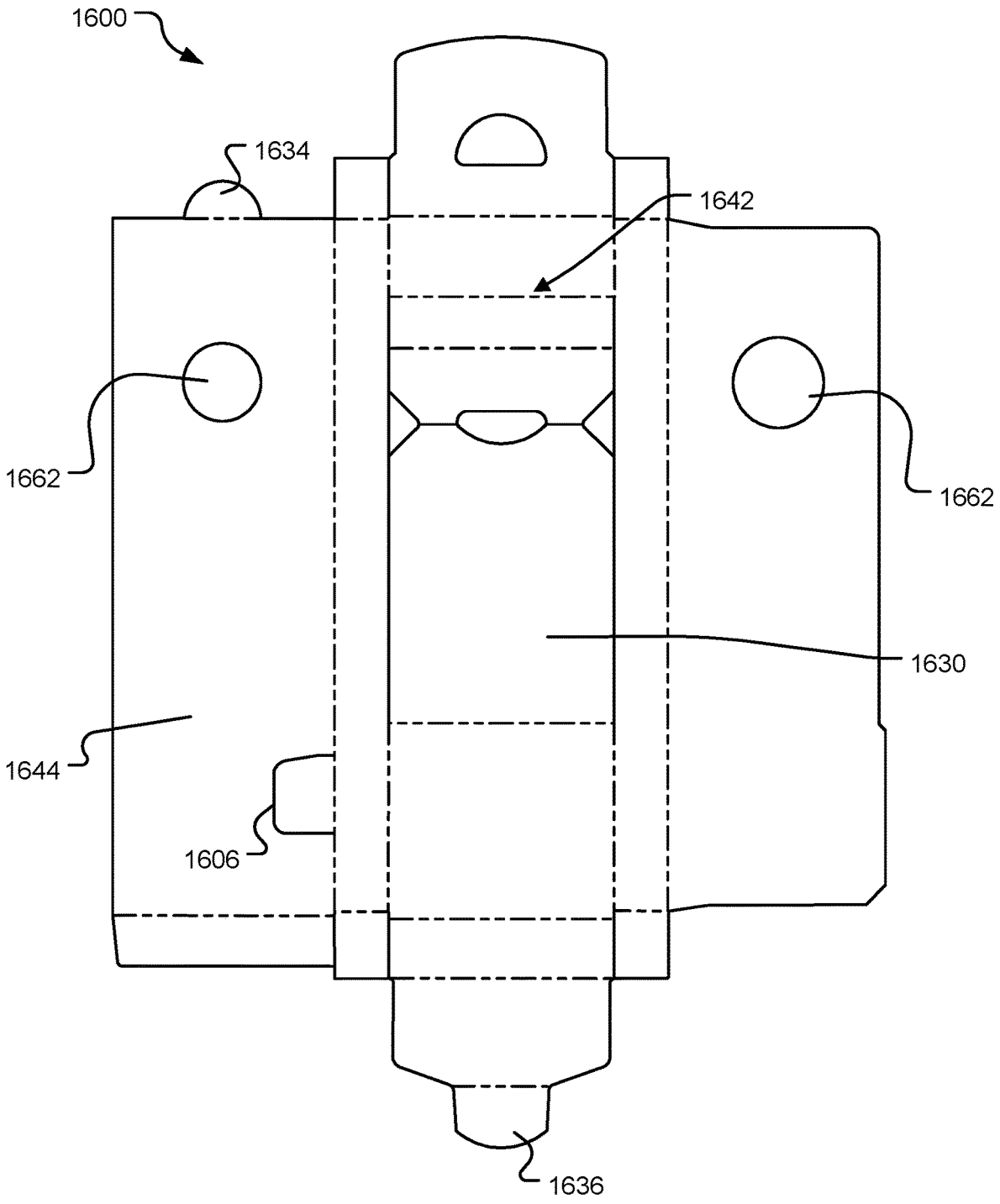
FIG. 16 illustrates a plan view of an example outer sleeve of a packaging apparatus.

FIG. 15E shows a cross-sectional partial perspective view of the outer sleeve 1502 partially encompassing the inner sleeve 1504. The packaging apparatus 1500 is in a locked position, showing the second tab 1536 of the inner sleeve 1504 protrude through the third aperture 1540 of the outer sleeve 1502. At this position, a user has pulled the inner sleeve 1504 out of the outer sleeve 1502 via the pull tab 1534 to an end point, where the inner sleeve 1504 can no longer move out of the outer sleeve 1502. The FIG. 16 illustrates a plan view of an example unassembled inner sleeve 1600 of a packaging apparatus described in FIGS. 12A-I and FIG. 13. The dashed lines in FIG. 16 depict where the material of the packaging apparatus may be folded when it is assembled. The inner sleeve 1600 is shown with a front panel 1630, a back panel 1644, a first tab 1606, a pull tab 1634, a folding lid 1642, and a second tab 1636.

In some implementations, at least one aperture (e.g., aperture 1662) is located in an inner sleeve storage compartment formed once the packaging apparatus is assembled. The aperture 1662 is used for loading or unloading a longer cylindrical or another shaped item into the inner sleeve 1600. In some implementations, a user may utilize the aperture 1662 for access to move an item in the inner sleeve compartment. In some implementations, an item may enter the aperture 1662 and extend into the inner sleeve 1600 in a closed outer sleeve compartment (not shown) beyond the inner sleeve storage compartment. In other implementations, inserts may be used for holding, securing, and storing items in the inner sleeve 1600.

Figure 17:
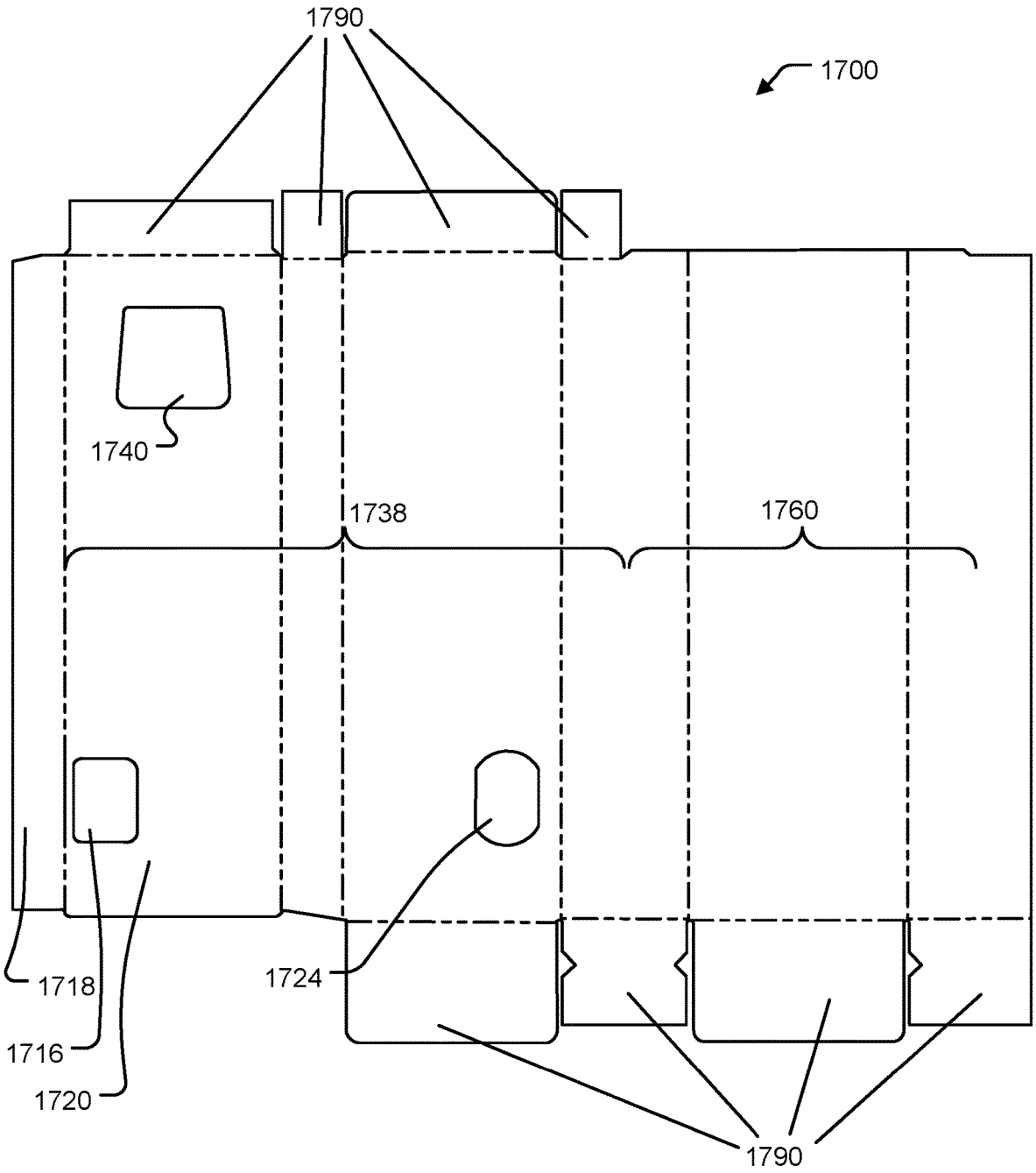
FIG. 17 illustrates a plan view of an example inner sleeve of a packaging apparatus.

FIG. 17 illustrates a plan view of an example unassembled outer sleeve 1700 of a packaging apparatus described in FIGS. 12A-I and FIG. 13. The dashed lines in FIG. 17 depict where the material of the packaging apparatus may be folded when it is assembled. Brackets (e.g., brackets 1738 and 1760) in FIG. 17 depict which panels are included in a closed outer sleeve compartment and an open outer sleeve compartment, respectively, when the outer sleeve is assembled. A side wall 1718 is a shared wall for both the closed outer sleeve compartment and the open outer sleeve compartment.

The closed outer sleeve compartment 1738 includes a first aperture 1716 shown on a front panel 1720. The open outer sleeve compartment 1760 includes a first flap 1724, which can open to reveal a second aperture (not shown) for access into the closed outer sleeve compartment 1738. An inner sleeve (not shown) may be inserted into the open outer sleeve compartment 1760.

FIG. 17 also shows end flaps 1790. The end flaps 1790 may be used on any end of the outer sleeve, inner sleeve, or other packaging apparatus component. The end flaps 1790 provide additional layers of materials on an end of the packaging apparatus and prevent tampering of the packaging apparatus. For example, once the packaging apparatus is assembled, the end flaps 1790 would prevent a child from breaking into or opening the end of the packaging apparatus. Any number of end flaps 1790 may be used, and they may be secured via any attaching means (e.g., gluing).

Figure 18:
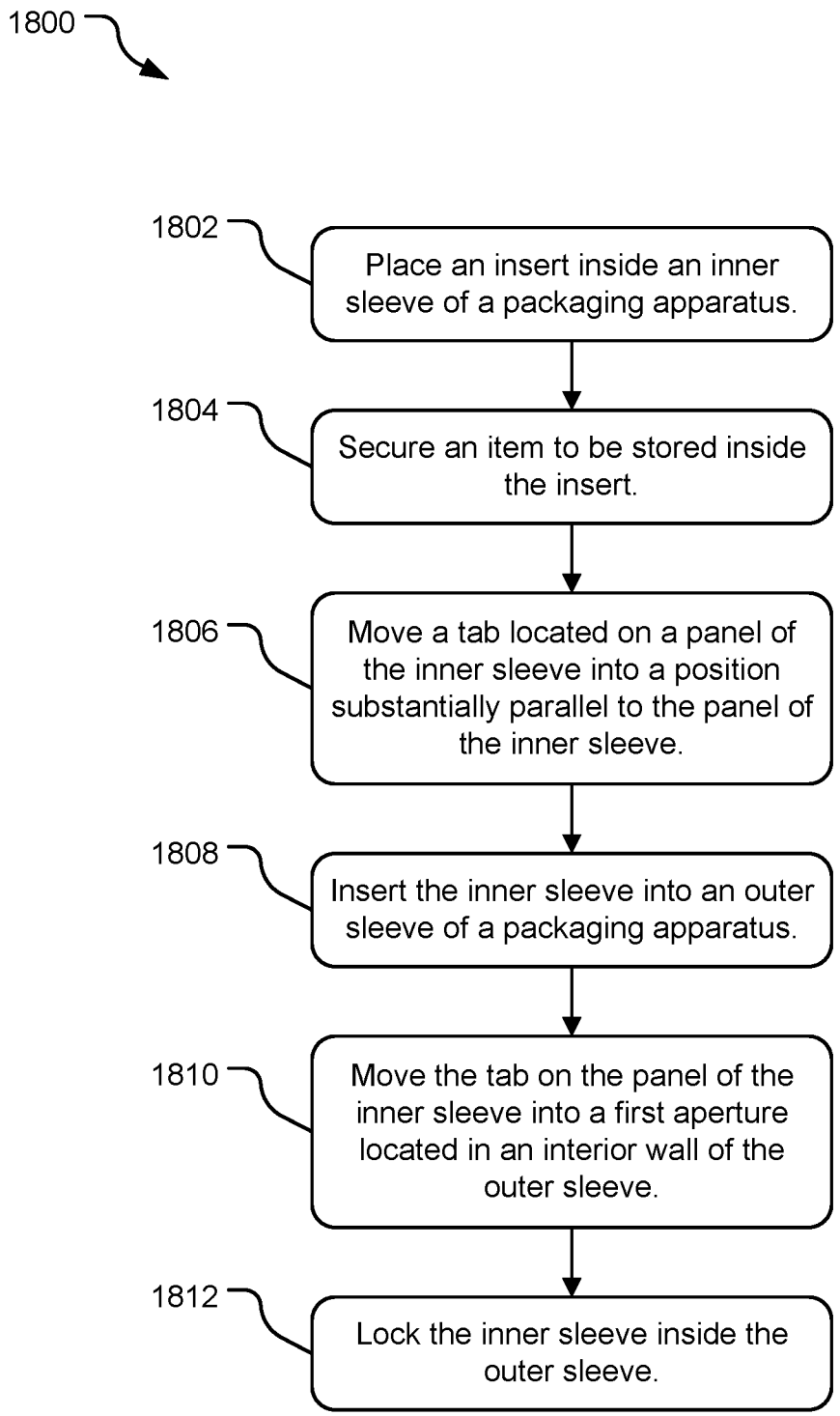
FIG. 18 is a flowchart of example operations of locking a packaging apparatus.

FIG. 18 is a flowchart of example operations 1800 of locking a packaging apparatus. An operation 1802 places an insert inside an inner sleeve of a packaging apparatus. An insert may be a specific insert configured to secure and store an intended item. In some implementations, there may be no insert and an item be placed directions into an inner sleeve storage compartment.

An operation 1804 secures an item to be stored inside the insert. Once the item is placed into the insert, or a storage compartment in the inner sleeve, the item may be secured. In some implementations, the item may be placed in a mouth or aperture in an insert or storage compartment that is configured to hold the item and prevent the item from moving within the inner sleeve. An item may be, for example, a glass vial that could break if it moved around the inner sleeve. Securing the item can protect the item from breakage.

An operation 1806 moves a tab located on a panel of the inner sleeve into a position substantially parallel to the panel of the inner sleeve. In some implementations, the panel is a side panel of the inner sleeve. In some implementations, the panel may be another panel, such as a front panel, a back panel, or an end panel of the inner sleeve. The substantially parallel placement of the tab allows the inner sleeve to be inserted into an outer sleeve of a packaging apparatus in an operation 1808. An operation 1810 moves the tab on the panel of the inner sleeve into a first aperture located in an interior wall of the outer sleeve. An operation 1812 locks the inner sleeve inside the outer sleeve by protruding through the aperture enough to prevent the inner sleeve from moving inside the outer sleeve.

Figure 19:
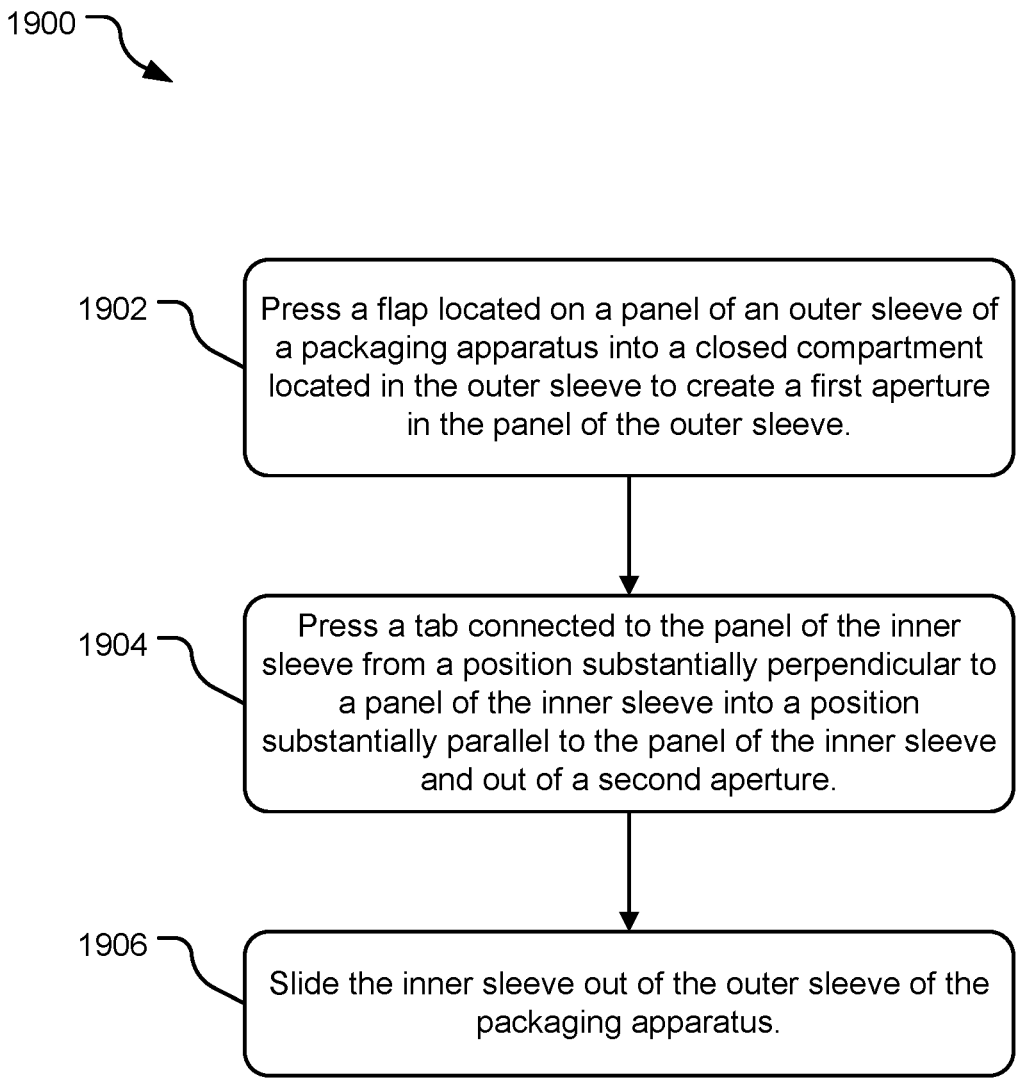
FIG. 19 is a flowchart of example operations of unlocking a packaging apparatus.

FIG. 19 is a flowchart of example operations 1900 of unlocking a packaging apparatus. An operation 1902 presses a flap located on a panel of an outer sleeve of a packaging apparatus into a closed outer sleeve compartment in the outer sleeve to create a first aperture in the panel of the outer sleeve. In some implementations, the panel is a side panel of the inner sleeve. In some implementations, the panel may be another panel, such as a front panel, a back panel, or an end panel of the inner sleeve. An operation 1904 presses a tab connected to the panel of the inner sleeve from a position protruding from a panel of the inner sleeve into a position substantially parallel to the panel of the inner sleeve and out of a second aperture. Once the tab has substantially parallel placement to the panel, the inner sleeve maybe be moved out of the outer sleeve. An operation 1906 slides the inner sleeve out of the outer sleeve of the packaging apparatus.

Figure 20:
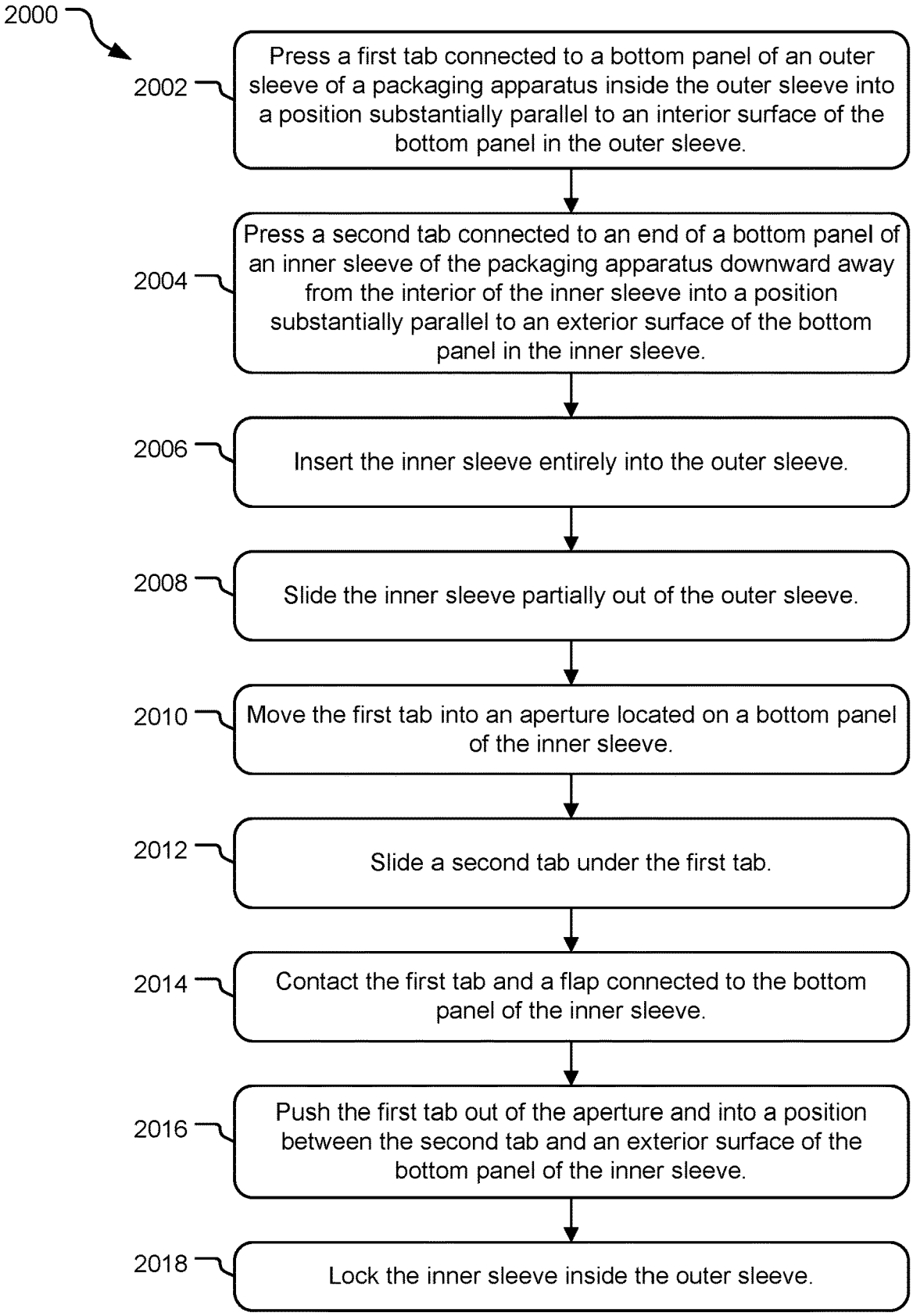
FIG. 20 is a flowchart of example operations of locking a packaging apparatus.

FIG. 20 is a flowchart of example operations 2000 of locking a packaging apparatus. An operation 2002 presses a first tab connected to a bottom panel of an outer sleeve of a packaging apparatus inside the outer sleeve into a position substantially parallel to an interior surface of the bottom panel of the outer sleeve.

An operation 2004 presses a second tab connected to an end of a bottom panel of an inner sleeve of the packaging apparatus downward away from the interior of the inner sleeve into a position substantially parallel to an exterior surface of the bottom panel in the inner sleeve.

The substantially parallel placement of the second tab allows the inner sleeve to be inserted into an outer sleeve of a packaging apparatus in an operation. An operation 2006 inserts the inner sleeve entirely into the outer sleeve.

An operation 2008 slides the inner sleeve partially out of the outer sleeve. An operation 2010 moves the first tab into an aperture located on a bottom panel of the inner sleeve. An operation 2012 slides a second tab under the first tab.

An operation 2014 contacts the first tab and a flap connected to the bottom panel of the inner sleeve. An operation 2016 pushes the first tab out of the aperture and into a position between the second tab and an exterior surface of the bottom panel of the inner sleeve. An operation 2018 locks the inner sleeve inside the outer sleeve. The inner sleeve may be partially removed from the outer sleeve but cannot be entirely removed from the outer sleeve.

Figure 21:
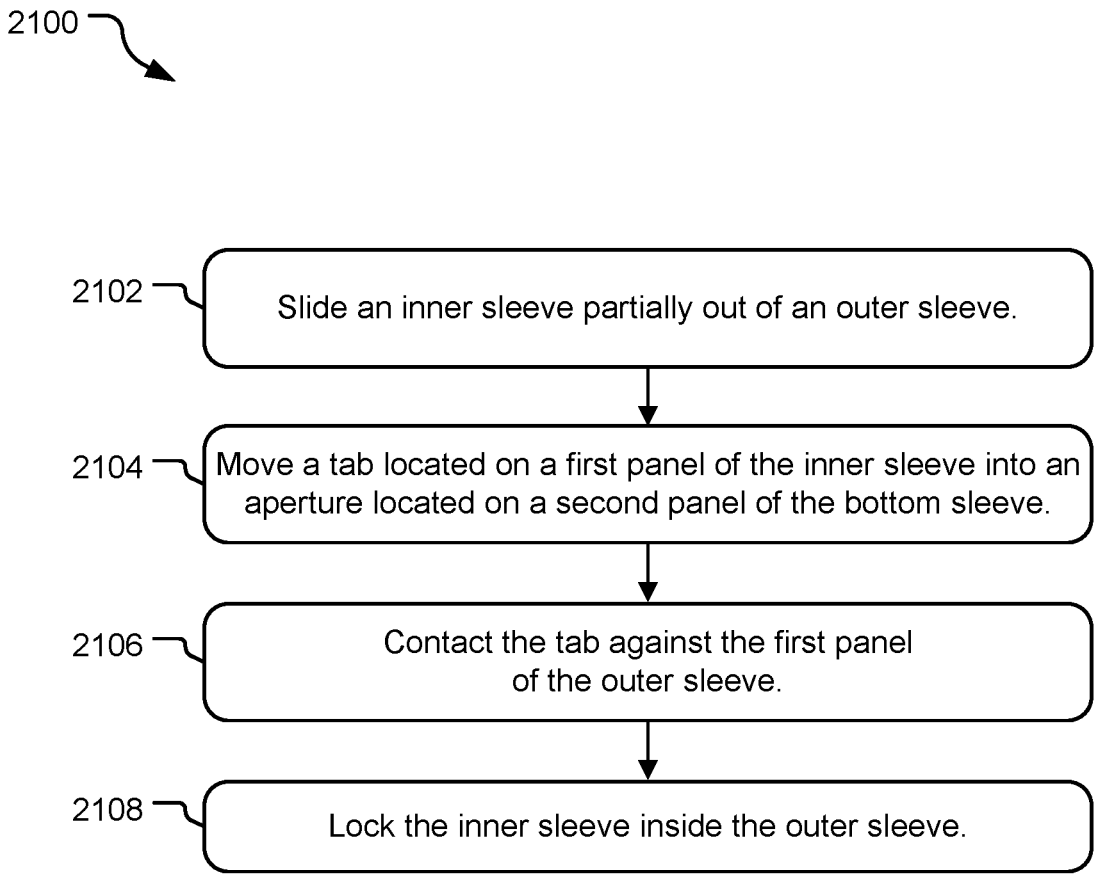
FIG. 21 is a flowchart of example operations of locking a packaging apparatus.

FIG. 21 is a flowchart of example operations 2100 of locking a packaging apparatus using the second locking mechanism described in FIGS. 12A-I. In some implementations, operations 2100 occur the packaging apparatus is locked and unlocked using the first locking mechanism described in FIGS. 12A-I.

An operation 2102 slides an inner sleeve partially out of an outer sleeve of a packaging apparatus. In some implementations, the inner sleeve has a first tab and a second tab connected to a first panel of the inner sleeve. The first tab and the second tab may be moved substantially parallel to the first panel of the inner sleeve, locating the second tab adjacent to the first tab in between the first tab and the first panel of the inner sleeve. The first tab may partial overlap the second tab. An operation 2104 moves the second tab located on the first panel of the inner sleeve into an aperture located on a first panel of the bottom sleeve. In some implementations, the second tab may have more than one joint, and an end joint may be bent facilitating the second tab to ride into the aperture. An operation 2106 contacts the second tab against the first panel of the outer sleeve. An operation 2108 locks the inner sleeve inside the outer sleeve. The inner sleeve may partially lock the inner sleeve in the outer sleeve. In some implementations, the inner sleeve may permanently lock the inner sleeve in the outer sleeve. The packaging apparatus may be partially opened for reuse but not disassembled as the inner sleeve cannot be removed from the outer sleeve.

In some implementations, the packaging apparatus is reusable and relockable. For example, after the operation 2108 locks the inner sleeve into the outer sleeve, the inner sleeve may be inserted again in its entirety in the outer sleeve and the packaging apparatus may be locked again and unlocked with the first locking mechanism (as described in FIGS. 12A-I and operations 1800), allowing the packaging apparatus to be opened and closed for use. In some implementations, the second locking mechanism will keep the inner sleeve partially locked in the outer sleeve and unable to disassemble into two separate components (the inner sleeve and the outer sleeve), and the first locking mechanism will allow opening and closing of the packaging apparatus in unlocked and locked positions.

In some implementations, the two locking mechanisms described in FIGS. 12A-I and in operations 1800 and 2100 may occur as a multi-stage operation. For example, the first locking mechanism locking the packaging apparatus where the outer sleeve encompasses the inner sleeve in its entirety may be a first stage operation. Then, the packaging apparatus is unlocked from the first locking mechanism and the inner sleeve is pulled out of the outer sleeve locking the inner sleeve partially in the outer sleeve via the second locking mechanism may be a second stage operation. In some implementations, there may be a third stage operation where after the second locking mechanism occurs, the first locking mechanism may be used to lock and unlock the inner sleeve in the outer sleeve in its entirety again. The third stage operation may occur iteratively, as the locking package is resusable.

Depending on the implementation, the tabs, the flaps, the apertures may be located on various panels of the inner sleeve and the outer sleeve, and should not be construed to be limited to the examples in the disclosure.

The disclosed apparatus may include an inner sleeve, including a first tab including memory-inducing laminated material, a second tab including memory-inducing laminated material, and an inner sleeve storage compartment, and an outer sleeve encompassing the inner sleeve when the storage apparatus is locked, and including a first aperture for receiving the first tab in a first locking mechanism, and a second aperture for receiving the second tab in a second locking mechanism. In some implementations, the first tab and the second tab are located proximate to each other and fold against a first panel of the inner sleeve wherein the second tab is located between the first tab and the first panel of the inner sleeve.

In some implementations, the outer sleeve comprises a third aperture for accessing the first locking mechanism. In some implementations, the apparatus includes a glue lap layer in the inner sleeve. In some implementations, the second locking mechanism is not accessible from an exterior surface of the storage apparatus. In some implementations, the first tab and the second tab fold against at least one layer of laminated material. In some implementations, the inner sleeve storage compartment is configured to receive a plurality of configurable inserts to hold items of predetermined sizes, and may include a folding lid where the folding lid folds into an inner sleeve end compartment in the inner sleeve storage compartment. In some implementations, the apparatus includes a perforated pull tab configured to tear off the inner sleeve. The apparatus may be child-resistant, lockable, relockable, reusable, and recyclable.

The disclosed methods may include pressing a first tab and a second tab connected to a panel of an inner sleeve of a storage apparatus substantially flush to a first panel of the inner sleeve, wherein the first tab locates on top of the second tab, inserting the inner sleeve into an open outer sleeve compartment of the storage apparatus, and locking the inner sleeve inside the outer sleeve by moving the first tab including memory-inducing laminated material into a first aperture located in an interior wall of the outer sleeve to a position protruding from the first panel of the inner sleeve and projecting out of the first aperture into a closed outer sleeve compartment. The methods may also include placing at least one insert into an inner sleeve storage compartment, wherein the at least one insert is configured to receive an item of predetermined size, and folding a folding lid in the inner sleeve into an inner sleeve end compartment in an inner sleeve storage compartment. The methods may also include locking the inner sleeve in its entirety inside the outer sleeve. The methods may also include pressing a third tab on the outer sleeve through a second aperture on the outer sleeve and into a closed outer sleeve compartment to access the first tab, pressing the first tab connected to the first panel of the inner sleeve from the position protruding from the interior wall of the outer sleeve into a position substantially parallel to the first panel of the inner sleeve out of the first aperture, sliding the inner sleeve out of the locked position in the outer sleeve of the storage apparatus, moving the second tab on the inner sleeve into a third aperture located on an interior side wall of the outer sleeve, and locking the inner sleeve partially inside the outer sleeve.

The logical operations making up the embodiments of the invention described herein are referred to variously as operations, steps, objects, or modules. Furthermore, it should be understood that logical operations may be performed in any order, adding or omitting operations as desired, unless explicitly claimed otherwise or a specific order is inherently necessitated by the claim language.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A child-resistant storage apparatus comprising:

an inner sleeve, including:

a first tab;

a second tab configured to locate at least partially between the first tab and a first panel of the inner sleeve when the first tab and the second tab are moved to a position substantially parallel to the first panel; and an inner sleeve storage compartment; and an outer sleeve to receive the inner sleeve in an open outer sleeve compartment inside the outer sleeve, the open outer sleeve compartment adjacent to a closed outer sleeve compartment inside the outer sleeve, the outer sleeve including:

a first aperture for receiving the first tab in the closed outer sleeve compartment which together form a first internal locking mechanism; and a second aperture for receiving the second tab in the closed outer sleeve compartment which together form a second internal locking mechanism.

2. The child-resistant storage apparatus of claim 1, wherein the first tab and the second tab include memory-inducing material.

3. The child-resistant storage apparatus of claim 1, wherein the first tab and the second tab include laminated material.

4. The child-resistant storage apparatus of claim 1, wherein the outer sleeve further comprises a third aperture for accessing the first internal locking mechanism via the closed outer sleeve compartment.

5. The child-resistant storage apparatus of claim 1, wherein the first internal locking mechanism locks the inner sleeve in its entirety in the outer sleeve.

6. The child-resistant storage apparatus of claim 1, wherein the second internal locking mechanism prevents the inner sleeve from sliding entirely out of the outer sleeve.

7. A method comprising:

pressing a first tab and a second tab of an inner sleeve of a child-resistant storage apparatus substantially parallel to a first panel of the inner sleeve, wherein the first tab at least partially locates on top of the second tab;

inserting the inner sleeve into an open outer sleeve compartment of an outer sleeve of the child-resistant storage apparatus;

moving the first tab from the open outer sleeve compartment into a first aperture located in an interior wall of the outer sleeve to a position protruding from the inner sleeve and into a closed outer sleeve compartment;

locking the inner sleeve inside the outer sleeve responsive to moving the first tab into a first aperture which together form a first internal locking mechanism;

sliding the inner sleeve from the outer sleeve of the storage apparatus;

moving the second tab into a second aperture located in the interior wall of the outer sleeve to a position protruding from the inner sleeve and through the second aperture into the closed outer sleeve compartment; and locking the inner sleeve partially inside the outer sleeve responsive to moving the second tab into the second aperture which together form a second internal locking mechanism.

8. The method of claim 7, further comprising:

pressing the first tab of the inner sleeve from the position protruding from the inner sleeve and through the first aperture into the closed outer sleeve compartment into a position substantially parallel to the first panel of the inner sleeve;

moving the first tab out of the first aperture from the closed outer sleeve compartment into the open outer sleeve compartment; and unlocking the inner sleeve from the outer sleeve responsive to moving the first tab out of the first aperture.

9. The method of claim 7, further comprising:

pressing a third tab on the outer sleeve through a third aperture on the outer sleeve and into the closed outer sleeve compartment to access the first tab.

10. The method of claim 7, further comprising:

storing an item inside an inner sleeve storage compartment of the inner sleeve.

11. The method of claim 10, further comprising:

placing at least one insert into an inner sleeve storage compartment, wherein the at least one insert is configured to receive an item of predetermined size.

12. The method of claim 7, wherein the first tab and the second tab include memory-inducing material.

13. The method of claim 7, wherein the first tab and the second tab include laminated material.

14. The method of claim 7, wherein the first internal locking mechanism locks the inner sleeve in its entirety in the outer sleeve.

15. The method of claim 7, wherein the second internal locking mechanism prevents the inner sleeve from sliding entirely out of the outer sleeve.

* * * * *